US008062718B2

(12) United States Patent
Schooley

(10) Patent No.: US 8,062,718 B2
(45) Date of Patent: Nov. 22, 2011

(54) INVERTIBLE CHRISTMAS TREE

(76) Inventor: Bruce A. Schooley, Alamo, CA (US)

( * ) Notice: Subject to any disclaimer, the term of this patent is extended or adjusted under 35 U.S.C. 154(b) by 18 days.

(21) Appl. No.: 12/798,496

(22) Filed: Apr. 5, 2010

(65) Prior Publication Data

US 2010/0196628 A1 Aug. 5, 2010

(51) Int. Cl.
*A47G 33/06* (2006.01)

(52) U.S. Cl. ..... 428/20; 428/18; 428/27; 362/123; 493/956

(58) Field of Classification Search ..... 428/17–20, 428/27; 362/123; 493/956
See application file for complete search history.

(56) References Cited

U.S. PATENT DOCUMENTS

| | | | | | |
|---|---|---|---|---|---|
| 1,397,931 | A | | 11/1921 | Kurtz | |
| 1,576,629 | A | * | 3/1926 | Culp | 211/197 |
| 3,574,102 | A | | 4/1971 | Hermanson | |
| 3,643,292 | A | | 2/1972 | Mayer | |
| 3,819,457 | A | | 6/1974 | Mottel | |
| 3,849,834 | A | | 11/1974 | Mayer | |
| 3,879,146 | A | | 4/1975 | Mayer | |
| 3,900,637 | A | | 8/1975 | Byrd | |
| 3,928,689 | A | | 12/1975 | Mottel | |
| 4,109,345 | A | | 8/1978 | Sargent | |
| 4,140,823 | A | | 2/1979 | Weskamp | |
| 4,144,364 | A | * | 3/1979 | Tice | 428/9 |
| 4,496,615 | A | | 1/1985 | Huang | |
| 5,652,032 | A | * | 7/1997 | Kaczor et al. | 428/18 |
| 5,855,705 | A | | 1/1999 | Gauthier | |
| 7,122,230 | B1 | | 10/2006 | Maskell | |
| 7,160,588 | B2 | * | 1/2007 | Sanford et al. | 428/18 |
| 7,267,852 | B1 | * | 9/2007 | Rosado et al. | 428/20 |
| 7,445,824 | B2 | * | 11/2008 | Leung et al. | 428/20 |
| 2008/0038490 | A1 | * | 2/2008 | Tennison | 428/18 |
| 2009/0061120 | A1 | * | 3/2009 | Leung et al. | 428/20 |

FOREIGN PATENT DOCUMENTS

| | | |
|---|---|---|
| WO | WO 97-37572 | 10/1997 |

* cited by examiner

*Primary Examiner* — Aaron Austin
(74) *Attorney, Agent, or Firm* — Heisler & Associates

(57) ABSTRACT

An artificial Christmas tree includes a central trunk broken into at least two separate portions including a fixed trunk portion and at least one rotating trunk portion. The fixed trunk extends up from an underlying base. Rotating trunks rotatably attach at midpoints thereof at least indirectly to an upper end of the fixed trunk. Limbs are pivotably attached to the rotating trunks with optional lights coupled thereto. These limbs pivot between a perpendicular orientation extending from the rotating trunks and a collapsed configuration closer to a centerline of the rotating trunks. The rotating trunks can be pivoted from a first collapsed configuration with a first end above a second end to a deployed configuration with the second end above the first end. During such pivoting, the limbs attached to the rotating trunk transition between a collapsed to a deployed configuration automatically. A wheeled base and cover further facilitate storage and deployment.

24 Claims, 12 Drawing Sheets

F
140
102
104
106
108
110
30
20

G
50
40

80
142

INVERTIBLE CHRISTMAS TREE

CROSS-REFERENCE TO RELATED APPLICATIONS

This application claims priority from International Patent Application No. PCT/US2008/013587 filed on Dec. 10, 2008.

FIELD OF THE INVENTION

The following invention relates to artificial trees and particularly artificial Christmas trees which can be collapsed and stored when not in use and deployed when intended to be used. More particularly, this invention relates to collapsible Christmas trees which collapse by rotation of one portion of the Christmas tree relative to a second portion of the Christmas tree, and associated bags to cover such trees when not in use.

BACKGROUND OF THE INVENTION

When decorating a space, it is often desirable to include trees as part of such decorations. To allow such decorations to last substantially indefinitely without maintenance and allow for repeated cycles of storage and deployment of such decorations, it is desirable to provide artificial trees rather than live trees. An example of such decorations are Christmas trees typically deployed during holiday seasons occurring at the end of each calendar year.

Such artificial Christmas trees are often configured to be collapsible so that they take up a minimum of space during initial shipping and inventory before being sold, and also to allow the user to store the Christmas tree when not in use in a relatively small space and protected from damage. Some such collapsible Christmas trees or other trees have limbs which are removably attached from a central trunk. The limbs typically include further branches which extend from the limbs which can be formed of wire or other materials with the limbs formed of wood, steel or other relatively rigid materials and the central trunk formed of wood, metal or other materials that are substantially rigid and strong enough to handle the loads encountered by carrying the limbs. Typically, needles of an artificial nature are fastened by wire, adhesive or otherwise to the branches extending from the limbs or directly to the limbs themselves.

In some cases lighting is permanently fixed to the limbs, such as with lights coupled to cords and with the cords plugging into a central cord running up the trunk. With other collapsible Christmas trees the limbs are not removed from the trunk but rather pivot from a stored orientation to a deployed orientation. With such trees the deployed orientation is generally perpendicular to the trunk and the stored orientation is somewhere between 45° pivoted away from horizontal to a substantially vertical orientation parallel to the trunk.

While such pivotable limbs on Christmas trees have the benefit of avoiding the requirement that the limbs be attached to the central trunk, difficulty is encountered in transitioning the limbs from a collapsed orientation to a deployed orientation. Either the limb reorienting process is highly labor intensive as each limb is adjustably positioned, or if deployed by reorienting the trunk, requires that the entire tree be picked up and reoriented in various different ways.

This tree reorienting procedure is a particularly difficult maneuver in that the tree must be held away from the body of the individual before rotation. Many individuals lack the strength, arm length and dexterity to perform such a maneuver. For others, such a maneuver is dangerous to perform, presenting the possibility of injury or damage to the user or the tree. Accordingly, a need exists for a Christmas tree or other artificial tree which can be easily reconfigured from a collapsed configuration to a deployed configuration with a minimum of strength or dexterity being required for such tree deployment.

SUMMARY OF THE INVENTION

With this invention an artificial Christmas tree is provided which can be readily inverted and which has limbs pivotably attached to a central trunk for automatic deployment of the limbs of the Christmas tree upon such inversion of the Christmas tree. To facilitate such inversion, the trunk includes at least two trunk portions including a first trunk portion adapted to be supported above a floor and at least one second trunk portion pivotably attached to the first trunk portion, at least indirectly, through at least one pivot joint. The first trunk portion extends from a lower end to an upper end with the pivot joint located closer to the upper end than to the lower end and typically adjacent the upper end.

The at least one second trunk portion has a portion thereof between a first end and a second end of the second trunk portion pivotably attached at least indirectly through the pivot joint to the first trunk portion. This pivot joint allows the at least one second trunk portion to pivot substantially 180° from a collapsed orientation extending substantially vertically to a deployed orientation extending substantially vertically, but with the first and second ends having swapped. In particular, in a collapsed orientation the first end is above the second end. In the deployed orientation the second end of the second trunk portion is above the first end.

The limbs are pivotably attached to the at least one second trunk portion. These limbs pivot between a perpendicular orientation and a collapsed orientation pivoting toward the second end of the second trunk portion somewhat away from the deployed position. Such pivoting can occur by gravity or through manual movement of the limbs. If by gravity alone, merely rotating the second trunk portion about the pivot joint between the collapsed orientation and the deployed orientation allows the limbs to pivot from their collapsed position to their deployed substantially perpendicular to the second trunk portion position. Thus, in a simplest embodiment of the invention, all one need do is invert the second trunk portion 180° while the entire weight of the second trunk portion is supported by the first trunk portion resting upon a floor or other underlying surface.

A clasp is preferably provided to selectively secure the at least one second trunk portion in the deployed orientation (and optionally also in the stored orientation) to avoid inadvertently inverting the at least one second trunk portion after deployment thereof. Lights preferably run up the first trunk portion then transition to the second trunk portion at the pivot joint and then toward each end of the second trunk portion and out at least some of the limbs, to provide lights for the Christmas tree or other artificial tree.

A wheeled base is optionally provided to further facilitate deployment of the artificial tree where desired. A top cap is preferably removably attachable to the second end of the second trunk portion to provide an uppermost portion of the tree. This uppermost portion can also include lights thereon with an appropriate plug to provide electrical connection when the cap is coupled to the second end at the top of the deployed at least one second trunk portion of the deployed Christmas tree.

OBJECTS OF THE INVENTION

Accordingly, a primary object of the present invention is to provide an artificial tree which can be easily transitioned from a collapsed orientation to a deployed orientation.

Another object of the present invention is to provide a Christmas tree which is easy to store in a collapsed form and easy to deploy when to be used.

Another object of the present invention is to provide a Christmas tree which can be transitioned from a collapsed form to a deployed form without requiring high strength or dexterity.

Another object of the present invention is to provide a Christmas tree which can be transitioned between a collapsed and a deployed configuration without damage to the Christmas tree.

Another object of the present invention is to provide a Christmas tree which can be readily transitioned between a collapsed and a deployed position with lights associated with the Christmas tree remaining coupled to various different portions of the Christmas tree both in the collapsed and the deployed configuration.

Another object of the present invention is to provide a Christmas tree which can be set up quickly.

Another object of the present invention is to provide a method for transitioning an artificial Christmas tree from a collapsed configuration to a deployed configuration.

Another object of the present invention is to provide an artificial tree which can be inverted between an upside down storage position and a right side up deployed position.

Another object of the present invention is to provide a cover for an artificial Christmas tree that can be inverted with the Christmas tree during set-up of the tree.

Another object of the present invention is to provide an artificial tree with one fixed trunk portion extending up from a base on the ground and multiple rotating trunk portions that rotate at least somewhat independently to provide multiple levels of a large artificial tree when rotated into a deployed position.

Other further objects of the present invention will become apparent from a careful reading of the included drawing figures, the claims and detailed description of the invention.

DESCRIPTION OF THE PREFERRED EMBODIMENT

Figure 4:
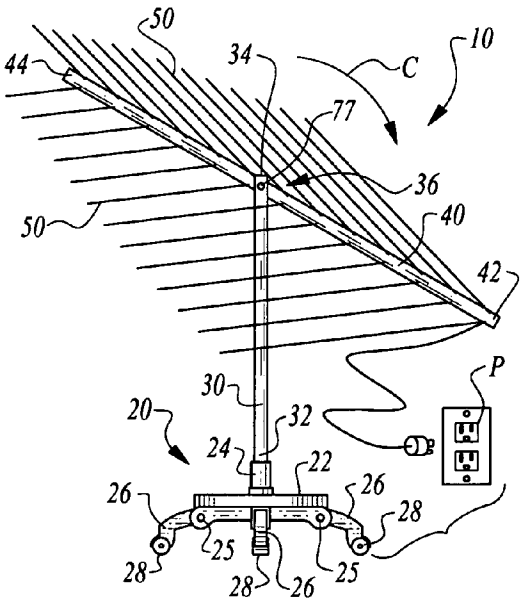
FIGS. 1-7 are front elevation views of the invertible Christmas tree of this invention at various different stages from a completely collapsed stored configuration to a completely deployed and illuminated configuration revealing the various steps in a method of deploying the collapsible Christmas tree of this invention.

Referring to the drawings, wherein like reference numerals represent like parts throughout the various drawing figures, reference numeral 10 is directed to an invertible Christmas tree or other artificial tree. The tree 10 is invertible (FIG. 4) so that it can transition between an upside down stored orientation (FIG. 3) with limbs angling downwardly to decrease a width of the collapsed Christmas tree, and a deployed orientation (FIG. 5) with the limbs pivoted to an orientation substantially perpendicular to the trunk. The user thus need not pick up the Christmas tree 10 at any time to convert it from its stored orientation to its deployed orientation.

In essence, and with particular reference to FIGS. 3-7, basic details of the invertible Christmas tree 10 of this invention are described according to a preferred embodiment. The tree 10 includes a base 20 upon which the entire Christmas tree 10 is supported above an underlying floor. A fixed trunk 30 extends vertically up from the base 20. This fixed trunk 30 extends approximately half of a height of the tree 10. Near an upper end 34 of the fixed trunk 30 a pivot 36 is provided. This pivot 36 rotatably supports a rotating trunk 40 thereto. The rotating trunk 40 preferably has a length similar to a height of the Christmas tree (less the height of a cap portion 80), with the rotating trunk 40 pivotably coupled to the fixed trunk 30 through the pivot 36 near a midpoint of the rotating trunk 40.

Figure 3:
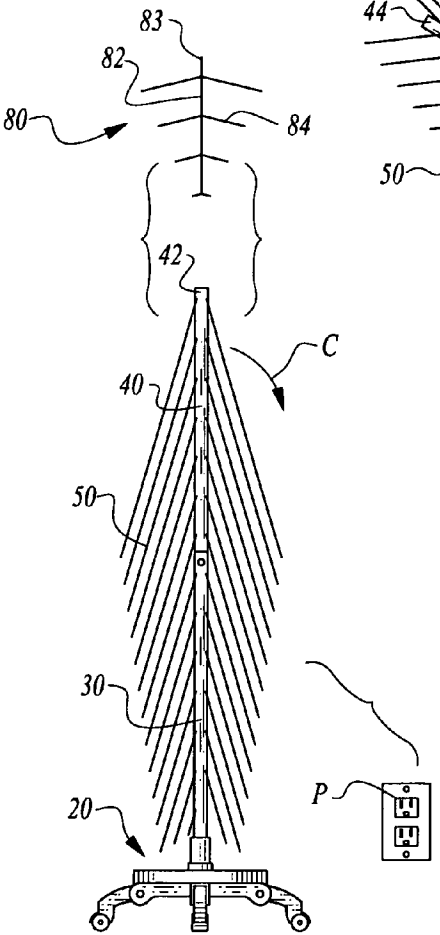

Limbs 50 extend laterally from the rotating trunk 40. Preferably, these limbs 50 are pivotably connected to the rotating trunk 40 so that the limbs 50 can pivot relative to the trunk between an approximately perpendicular deployed orientation and a collapsed orientation which pivots toward the trunk. Thus, the limbs 50 extend substantially horizontally when the rotating trunk 40 is in a final position for deployment of the limbs 50, and the limbs 50 pivot toward the rotating trunk 40 when the rotating trunk 40 is rotated to a stored position (FIG. 3). Branches 60 typically extend from each limb 50. Lights 70 are typically routed up the fixed trunk 30, out to each end of the rotating trunk 40 and then out the limbs 50 potentially out onto branches 60 supported by the limbs 50. The lights receive power such as through a power receptacle P. A cap 80 is preferably provided which attaches to an end of the rotating trunk 40 to provide an uppermost portion of the tree 10 after the rotating trunk 40 has been rotated to a deployed orientation.

Figure 2:
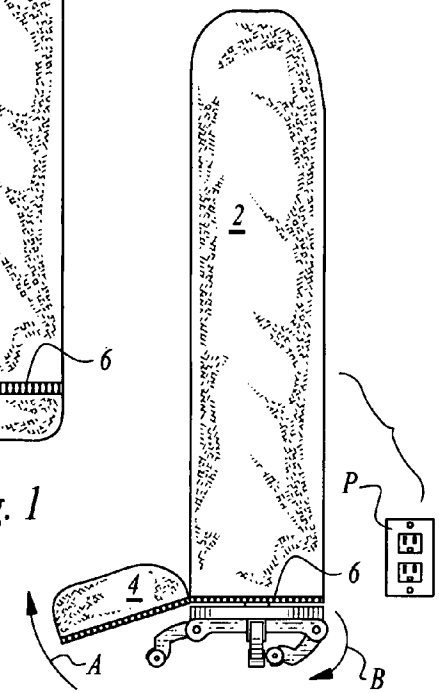
Figure 1:
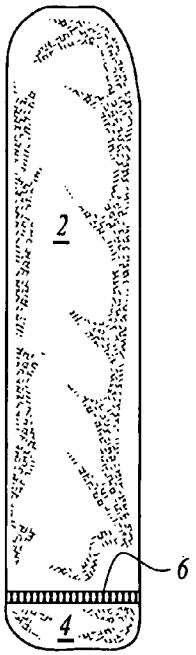

More specifically, and with initial reference to FIGS. 1 and 2, details of accessories for the invertible Christmas tree 10 are described for use when the invertible Christmas tree 10 is in a stored configuration. These accessories preferably include a substantially cylindrical cover 2 with a diameter sized to fit over the invertible Christmas tree 10 when it is in its stored position (FIG. 3). Typically the cap 80 can also fit inside this cover 2. A lid 4 is preferably also provided which can move relative to the cover 2 (such as along arrow A of FIG. 2) and attach to the cover 2, such as through a zipper 6. The lid 4 is particularly useful during shipping or when the invertible Christmas tree 10 is to be stored on its side. Otherwise, the lid 4 is not required. With the cover 2 on the invertible Christmas tree 10, the entire invertible Christmas tree 10 can be rolled into a closet or other storage area and be kept clean and keep the Christmas tree from damaging other objects, such as within the closet.

With particular reference to FIGS. 2-4, details of the base 20 of the invertible Christmas tree 10 are described according to a preferred embodiment. The base 20 provides a preferred form of means to support the invertible Christmas tree 10 above an underlying ground surface, such as a floor of a residential structure. This base 20 has sufficient width to provide stability for the invertible Christmas tree 10 to prevent it from tipping over. The base 20 also preferably elevates lowermost portions of the invertible Christmas tree 10 somewhat above an underlying surface. This base 20 in this most preferred embodiment is a wheeled base 20 including wheels 28 thereon so that the entire invertible Christmas tree 10 can be rolled about on the underlying surface for easy transportation, such as between a stored location and a deployed location.

The base 20 includes a plate 22 which is preferably circular or square in form and oriented generally horizontally. A pedestal 24 extends vertically upward from a central portion of the plate 22. The pedestal 24 is configured to be fixedly attached to the fixed trunk 30 with the fixed trunk 30 preferably extending vertically upward from the pedestal 24.

Lateral portions of the plate 22 support joints 25. These joints 25 preferably have legs 26 pivotably attached to the plate 22 therethrough. Thus, the joints 25 allow the legs 26 to pivot relative to the plate 22 (about arrow B of FIG. 2). Wheels 28 are preferably provided at the end of each of these legs 26. The wheels 28 are preferably on casters or other swivel joints.

With such a configuration, the base 20 can have a deployed configuration with the legs 26 extending radially outwardly for maximum stability, but the legs 26 can be pivoted inwardly (arrow B) to provide a lesser width and to allow the lid 4 to be closed over the base 20 and to completely enclose the invertible Christmas tree 10 within the cover 2 when desired (FIG. 1).

While the base 20 shown herein is described according to this preferred embodiment, other bases 20 could also be utilized. For instance, the base 20 could merely be a fixed structure having sufficient width to resist tipping of the invertible Christmas tree 10. Also, the base 2 could merely be a hole in an underlying floor into which the fixed trunk 30 of the invertible Christmas tree 10 would be removably mounted. Other forms of Christmas tree stands could also be utilized to support the fixed trunk 30 and dispense with the base 20 altogether.

With continuing reference to FIGS. 3-7 and 8-10, details of the fixed trunk 30 of the invertible Christmas tree 10 are described according to this preferred embodiment. The invertible Christmas tree 10 preferably includes a central trunk formed of two separate trunk portions including a first portion referred to as a fixed trunk 30 and a second portion referred to as a rotating trunk 40. Also, a top trunk 82 is provided as a portion of the cap 80 defining a small portion of the overall trunk structure of the invertible Christmas tree 10.

The fixed trunk 30 preferably has a height substantially half of that of the invertible Christmas tree 10. The fixed trunk 30 is elongate in form and can be configured such as in a solid cylindrical form or in the form of a cylindrical tube. The fixed trunk 30 is formed of substantially rigid material and carries loads of the invertible Christmas tree 10 upon the base 20 or other underlying surface.

Figure 5:
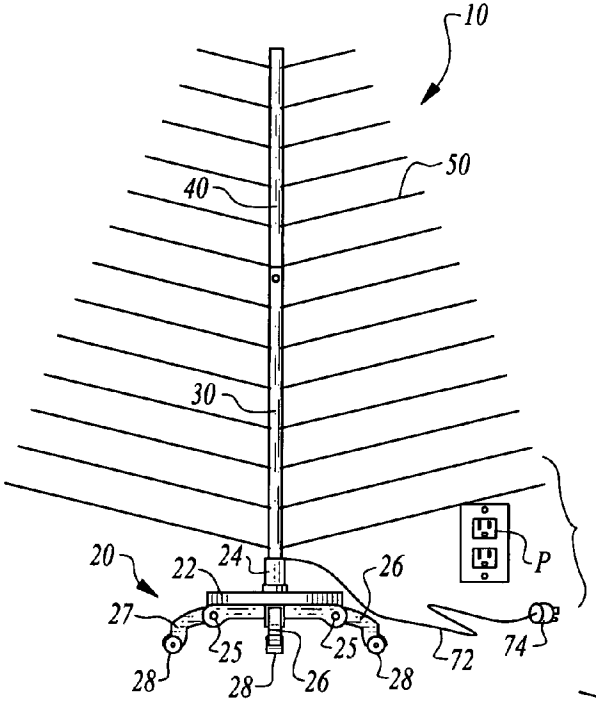
Figure 8:
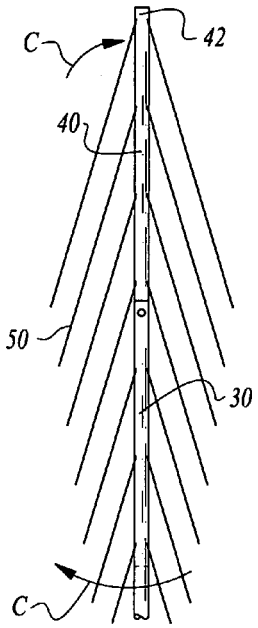
FIGS. 8-10 are details of FIGS. 3-5 revealing details of the invertible Christmas tree of this invention around a central pivot joint which allows a second trunk portion of the Christmas tree to pivot relative to a first trunk portion of the Christmas tree.
Figure 11:
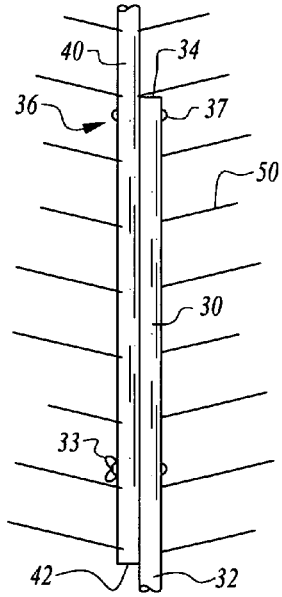
FIG. 11 is a detail of a portion of that which is shown in FIG. 10 and from a side view taken along lines 11-11 of FIG. 10.

The fixed trunk 30 includes a lower end 32 opposite an upper end 34. A clasp 33 is provided near the lower end 32. This clasp 33 is configured to be removably attached to a portion of the rotating trunk 40 to secure the rotating trunk 40 in either the stored configuration (FIG. 3) or in the deployed configuration (FIG. 5). This clasp structure is further particularly shown in FIGS. 10 and 11.

The upper end 34 of the fixed trunk 30 includes a pivot 36 adjacent thereto. This pivot 36 can be as simple as a hole passing laterally through the fixed trunk 30 with an axle 37 passing through this hole. In the embodiment depicted in FIGS. 3-11, the pivot 36 is in this simple form with the axle 37 providing for pivotable attachment between the rotating trunk 40 and the fixed trunk 30. The axle 37 has a length similar to twice a diameter of the fixed trunk 30.

The rotating trunk 40 has a diameter similar to that of the fixed trunk 30 and the axle 37 passes through both the fixed trunk 30 and the rotating trunk 40 with the rotating trunk 40 alignable parallel with the fixed trunk 30 but just slightly offset laterally from the fixed trunk 30 so that the rotating trunk 40 can rotate freely relative to the fixed trunk 30. If desired, the fixed trunk 30 can be spaced slightly away from a center of mass of the invertible Christmas tree 10 so that the rotating trunk 40 can have its center of mass more closely aligned with the center of mass of the overall invertible Christmas tree 10 for maximum stability.

Figure 18:
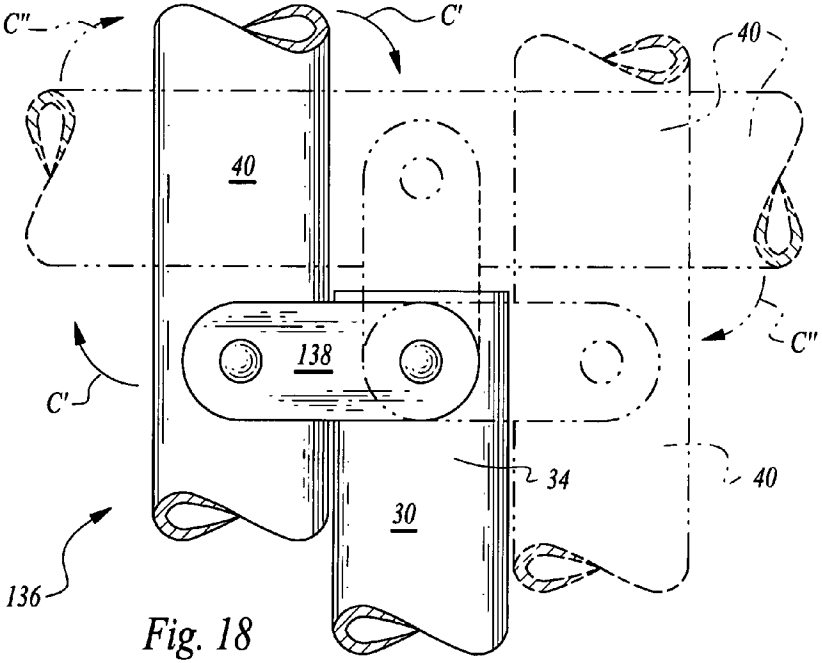
FIG. 18 is a front elevation view of an alternative pivot joint for joining the rotating trunk portion to the fixed trunk portion, with the repositioning of the rotating trunk shown in broken lines.
Figure 19:
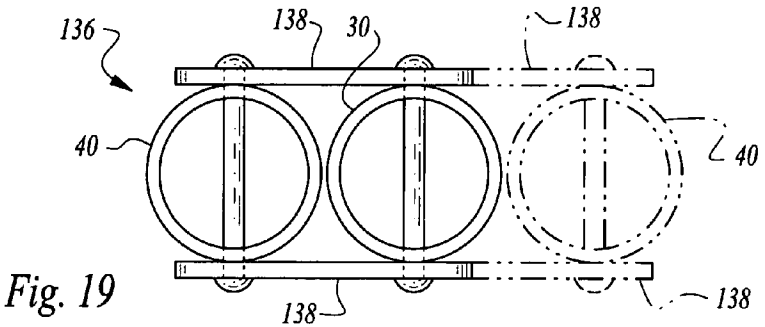
FIG. 19 is a top plan view of that which is shown in FIG. 18.

While the embodiment of FIGS. 3-10 is perhaps the simplest embodiment for the pivot 36, other embodiments of this pivot could be utilized, including those depicted in FIGS. 18-21. For instance, FIGS. 18 and 19 depict front and top views of an alternate joint 136 with a bracket 138 pivotably attached to the upper end 34 of the fixed trunk 30 and an end of the bracket 138 opposite the upper end 34 of the fixed trunk 30 either fixed or pivotably attached to the rotating trunk 40. Rotation of the rotating trunk 40 relative to the fixed trunk 30 occurs by first moving along arrow C', then moving along arrow C". 180° of rotation is achieved and the rotating trunk 40 moves from being directly adjacent the fixed trunk 30 on a first side thereof to being directly adjacent the fixed trunk 30 on a second side opposite the first side.

Figure 20:
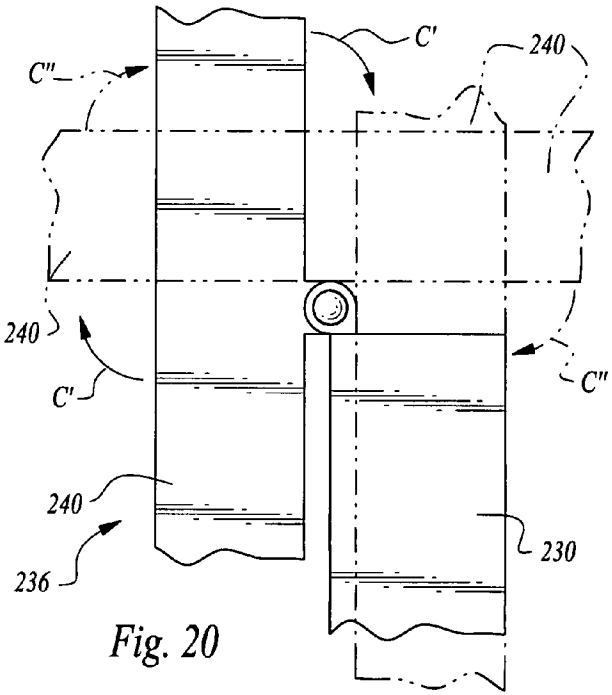
FIG. 20 is a front elevation view of a second alternative pivot joint for joining the rotating trunk to the fixed trunk, with the rotating trunk shown in broken lines after repositioning.
Figure 21:
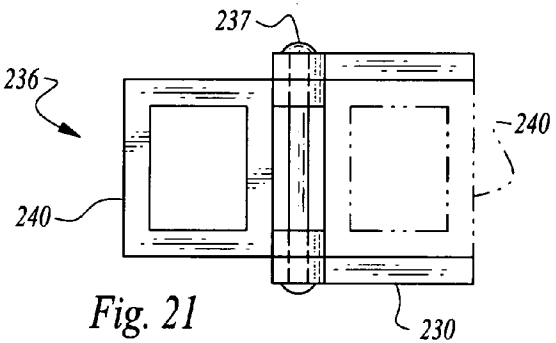
FIG. 21 is a top plan view of that which is shown in FIG. 20.

In FIGS. 20 and 21 another embodiment is provided in the form of a second alternative joint 236. An axle 237 is provided to allow the rotating trunk 240, having a square cross-section, to rotate relative to the fixed trunk 230 in the form of a generally square cross-sectioned structure having one open side opposite the side bearing the axle 237. In this embodiment, the rotating trunk 40 has a size slightly smaller than that of the fixed trunk 30 so that the rotating trunk 40 can rotate to nest inside the fixed trunk 30 when in one position, but pivot out of this nested configuration when in the second configuration after 180° of rotation (along arrow C' and then arrow C" (FIG. 20)). Other embodiments of joints or pivots could also be resorted to, to allow for pivotable attachment of the rotating trunk 40 to the fixed trunk 30.

With continuing reference to FIGS. 3-11, details of the rotating trunk 40 are described according to this preferred embodiment. The rotating trunk 40 preferably supports all of the limbs 50 of the invertible Christmas tree 10 thereon. As an alternative, multiple rotating trunks can be provided, such as upper and lower rotating trunks pivoting from an intermediate rotating trunk to the fixed trunk (see for instance FIGS. 32-36). This simple rotating trunk 40 has an elongate rigid form similar to that of the fixed trunk 30. However, the rotating trunk 40 preferably has a length similar to a height of the invertible Christmas tree (minus a height of the cap 80 and minus a height of the base 20 up to a top of the pedestal 24).

Figure 9:
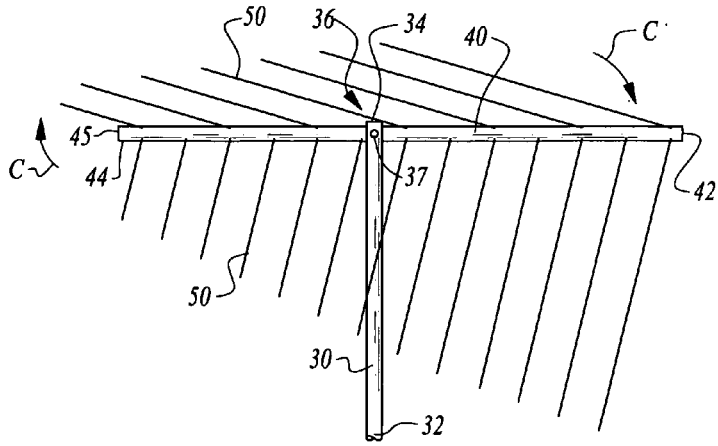
Figure 10:
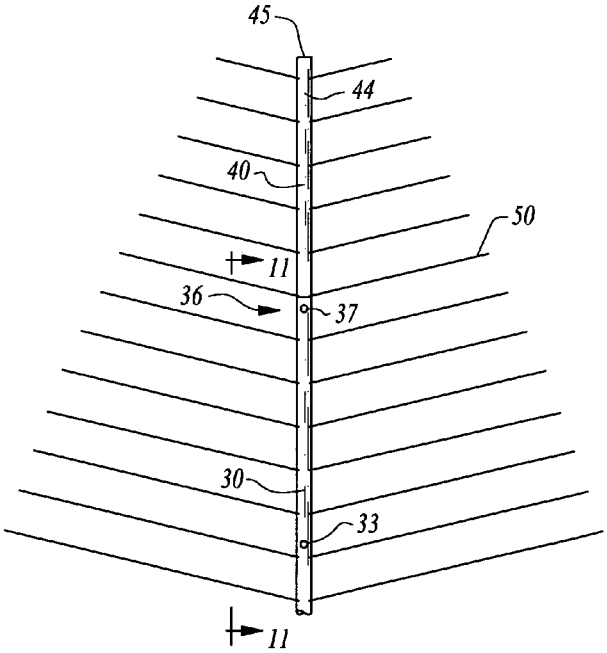

This rotating trunk 40 has a first end 42 opposite a second end 44 (FIGS. 4 and 9). The first end 42 is configured to be below the second end 44 when the rotating trunk 40 is in its deployed configuration. The rotating trunk 40 is configured to have the first end 42 above the second end 44 when in the stored configuration (FIG. 3). A port 45 is provided at the end of the second end 44 which can receive and support the cap 80 thereon.

A core 46 passing through an interior of the rotating trunk 40 is preferably hollow. Such a hollow core 46 minimizes weight of the rotating trunk 40 while maintaining strength for the rotating trunk 40 and also optionally provides a pathway through which electric equipment for the lights 70 can be routed. Slots 48 (FIGS. 12-17) are formed in the rotating trunk 40 through which limbs 50 can interface in a rotating fashion relative to the rotating trunk 40.

The rotating trunk 40 preferably has a center point or a point near the center point of the rotating trunk 40 which is pivotably attached (at least indirectly, and in this embodiment directly) to the fixed trunk 30 through the pivot 36. This midpoint is also preferably a center of mass of the rotating trunk 40. Thus, the rotating trunk 40 can be freely rotated 180° to move the first end 42 from directly above the second end 44 and directly above the fixed trunk 30, to a second position with the first end 42 adjacent the fixed trunk 30 and directly below the second end 44; with a center of mass of the rotating trunk 40 always remaining substantially aligned with the fixed trunk 30. Thus, the rotating trunk 40 can be "spun" without causing instability in the invertible Christmas tree 10 resting upon the base 20 or other support above a floor. Preferably, near each end 42, 44 of the rotating trunk 40 holes are provided which can interface with the clasp 33, so that the rotating trunk 40 can be secured to the fixed trunk 30 in both the collapsed configuration and the deployed configuration.

With particular reference to FIGS. 12-17, details of the limbs 50 and branches 60 of the invertible Christmas tree 10 are described according to a preferred embodiment. The limbs 50 could be attached to the rotating trunk 40 in many different ways including in fixed fashion or in a fashion which is removable but not pivotable. However, most preferably the limbs 50 are pivotably attached to the rotating trunk 40. Such pivoting preferably allows for rotation of the limbs 50 between a perpendicular orientation (actually substantially perpendicular but preferably slightly angled upwardly, when the rotating trunk 40 is oriented vertically) and a collapsed configuration closer to the angle of the rotating trunk 40 centerline than to perpendicular to the rotating trunk 40 centerline.

Figure 13:
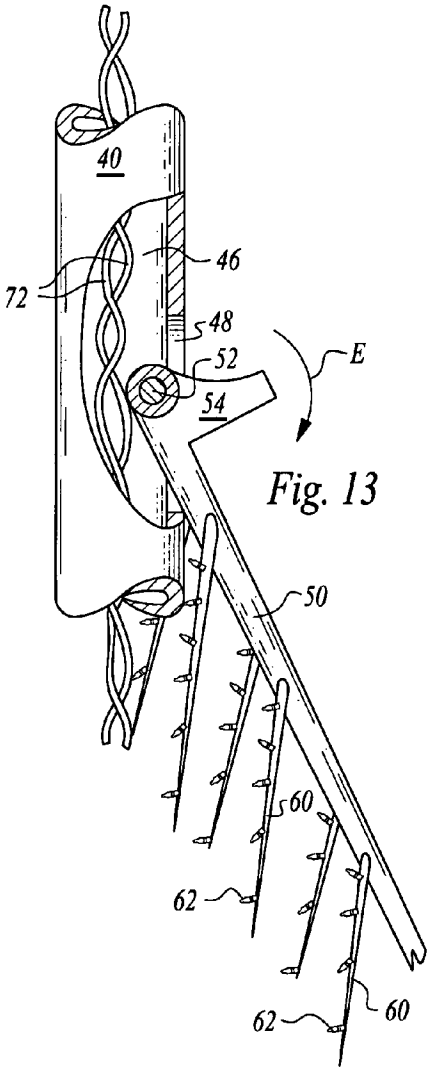
FIG. 13 is a detail similar to that which is shown in FIG. 12, but after inverting the second trunk portion so that the limb transitions to a stored configuration pivoting away from substantially perpendicular to the second trunk portion.
Figure 12:
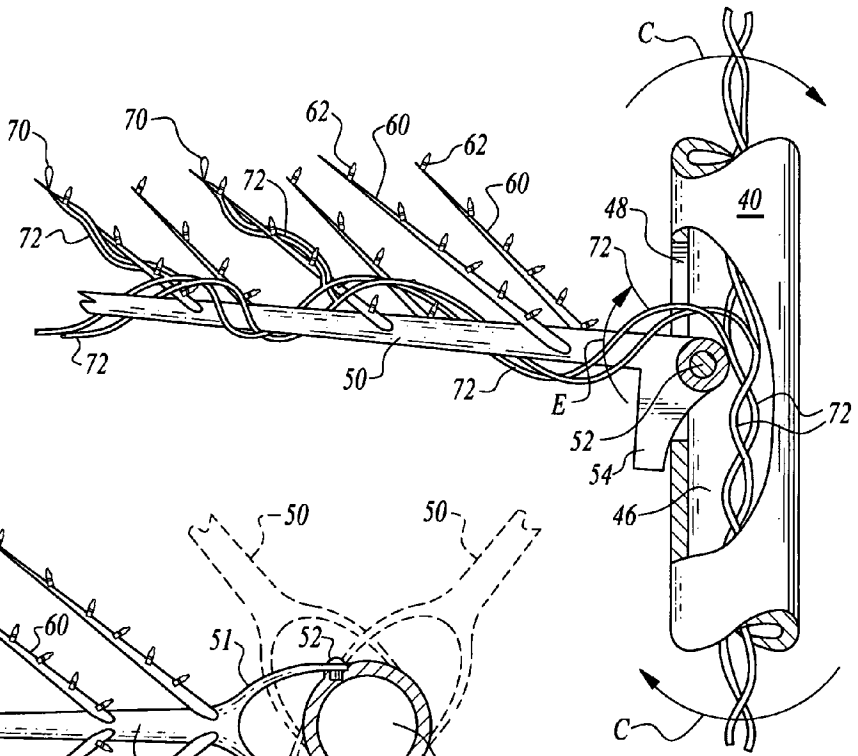
FIG. 12 is a detail of a portion of that which is shown in previous figures illustrating how a limb can be pivotably attached to the second trunk portion of the invertible Christmas tree of this invention.
Figure 14:
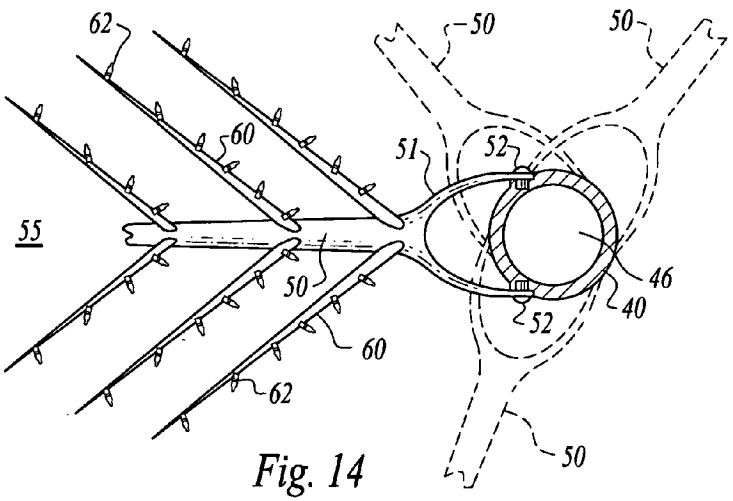
FIG. 14 is a top plan view of that which is shown in FIG. 12 further illustrating details of a limb according to one form of this invention and illustrating in broken lines how other limbs can be provided in different circumferentially spaced orientations from the second trunk portion of the invertible Christmas tree.
Figure 15:
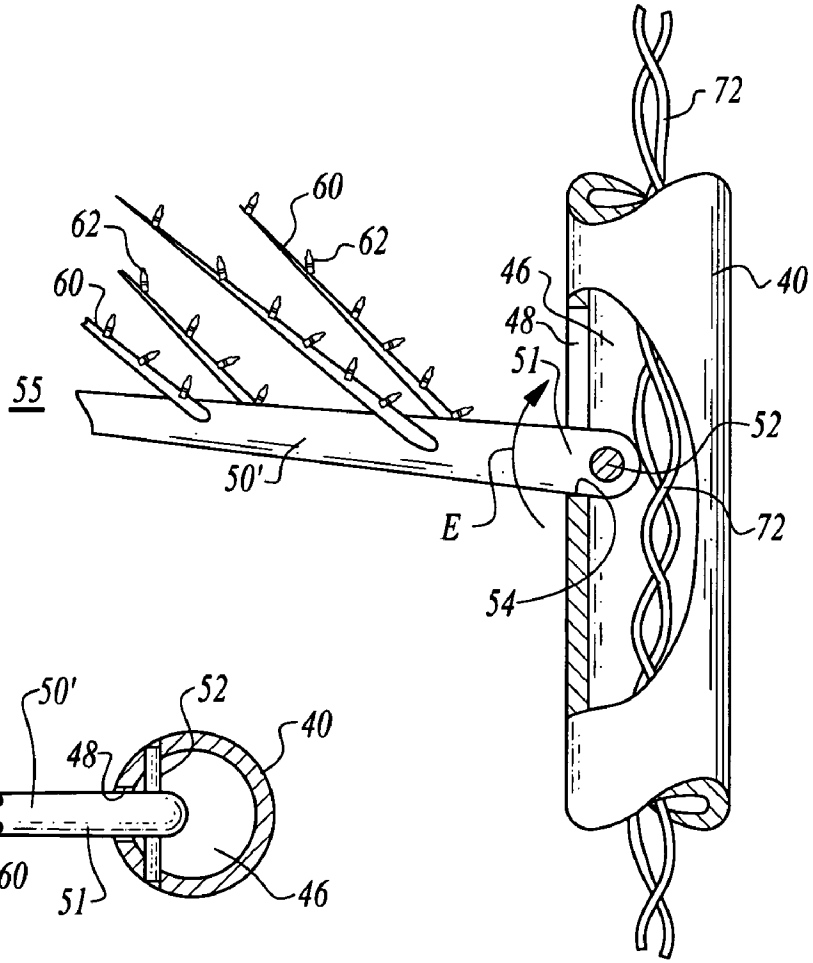
FIG. 15 is a detail similar to that which is shown in FIG. 12 but for an alternative embodiment limb and limb attachment to the second trunk portion.
Figure 17:
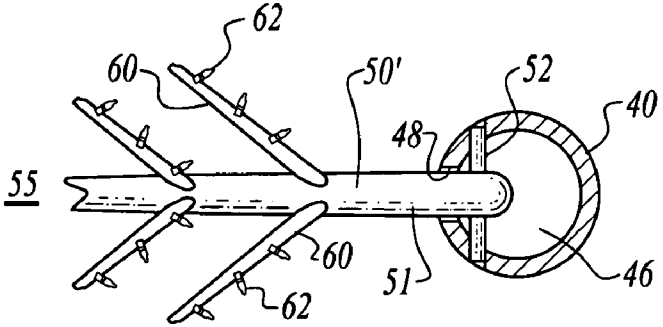
FIG. 17 is a top plan view of that which is shown in FIG. 15.

Most preferably, this collapsed angle for the limbs 50 is 70° away from the deployed configuration for the limbs 50. Such rotation of the limbs 50 is depicted by arrow E (FIGS. 12, 13 and 15). While the limbs appear to pivot upward, they in fact pivot downward after the rotating trunk 40 has rotated (about arrow C (FIG. 12)) so that the limbs 50 actually rotate downward by gravity forces, but only when the rotating trunk 40 has been rotated from the deployed configuration to the stored orientation. When this action is reversed and the rotating trunk 40 is rotated from the stored orientation to the deployed orientation, the limbs 50 pivot in an opposite direction to the deployed configuration approximately perpendicular to a centerline of the rotating trunk 40.

Each of the limbs 50 is preferably an elongate rigid structure with a plurality of such limbs 50 radiating from the rotating trunk 40. Most preferably, the limbs 50 extend in many different directions radially from the rotating trunk 40 (FIG. 14) when a complete symmetrical generally conical bushy invertible Christmas tree 10 is to be provided. The limbs 50 generally each include a root 51 defining an end thereof closest to the rotating trunk 40 and a tip 55 opposite the root 51. A hinge 52 is located at the root 51 to pivotably attach the limbs 50 to the rotating trunk 40. A stop 54 is provided to prevent the limbs 50 from rotating either past substantially horizontal and perpendicular to the rotating trunk 40 when in the deployed configuration or past a collapsed angle, such as 70°, away from the deployed orientation.

Figure 16:
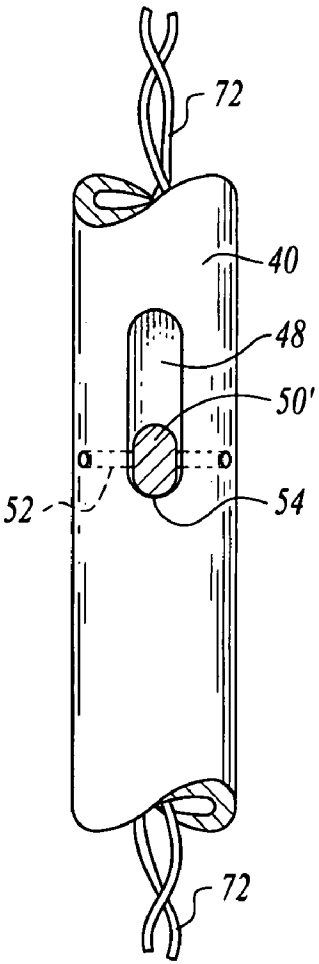
FIG. 16 is a side elevation view of that which is shown in FIG. 15.

In the embodiment of FIGS. 12 and 13 this stop 54 is in the form of a flange of material extending substantially perpendicularly from the extent of the limbs 50 from the root 51 to the tip 55. In the embodiment of FIGS. 15 and 16 the root 51 of the limbs 50 merely passes through a slot 48 in the rotating trunk 40 and a lower portion of this slot 48 acts as the stop 54. The hinge 52 generally includes at least one axle 52 or axle-like structure about which the limbs 50 can pivotably move relative to the rotating trunk 40.

Branches 60 optionally but preferably radiate from the limbs 50 in a pattern which mimics at least some natural tree or otherwise has a desirable form. Typically, needles 52 also extend from the branches 60. These needles 62 can be actual natural needles such as pine needles, but most typically are synthetic structures such as attached by wire or adhesive to the branches 60. It is also conceivable that needles 62 can also be directly attached to the limbs 50. The branches 60 can have a generally planar form such as might exist on a noble fir, or might have a more bushy cylindrical form which might be provided on many different types of pines. Needles 62 can also be long or short depending on the design characteristics desired for the invertible Christmas tree 10.

With particular reference to FIGS. 7 and 12-14, details of the lights 70 are described. Most preferably, the invertible Christmas tree 10 is also permanently wired with lights 70. A plug 74 is provided which is removably attachable to a power receptacle P. A cord 72 extends from the plug 74 and extends up the fixed trunk 30 to the rotating trunk 40. At the joint 36, this cord 72 preferably splits into two separate cords, one of which extends towards the first end 42 of the rotating trunk 40 and the other of which extends towards the second end 44 of the rotating trunk 40.

As these cords pass the limbs 50, the cords are routed out the limbs 50 and terminate at various different locations with lights 70. Various different controllers can be provided and various different lights can be provided if desired so that a variety of different light displays can be provided through the lights 70. The cord 72 can be routed through an interior of the fixed trunk 30 and through an interior of the rotating trunk 40 (and also conceivable through an interior of the limbs 50). Perhaps in a simplest form of the invention, the cord 72 can merely be wrapped around an exterior of the fixed trunk 30 and an exterior of the rotating trunk 40. The cord 72 can be camouflaged to have a color similar to that of the fixed trunk 30, rotating trunk 40 and limbs 50 (i.e. green) to help hide the cords 72.

Figure 7:
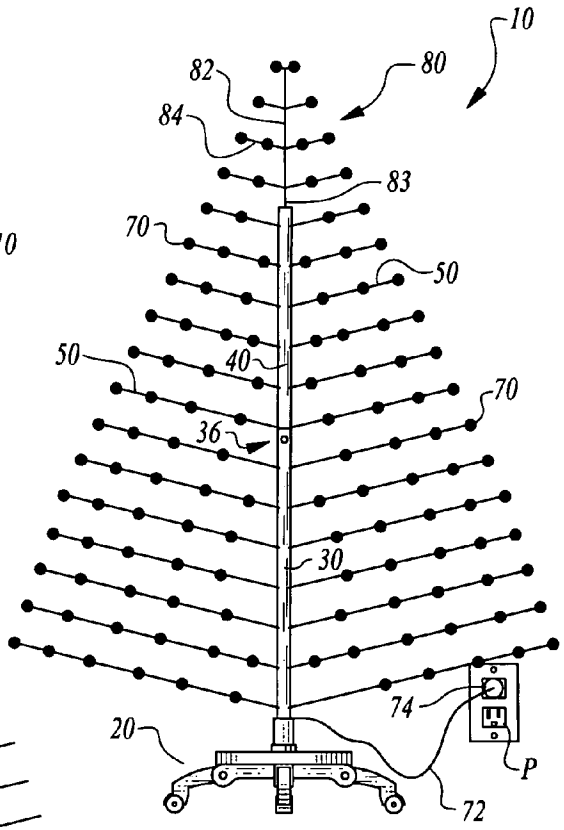
Figure 6:
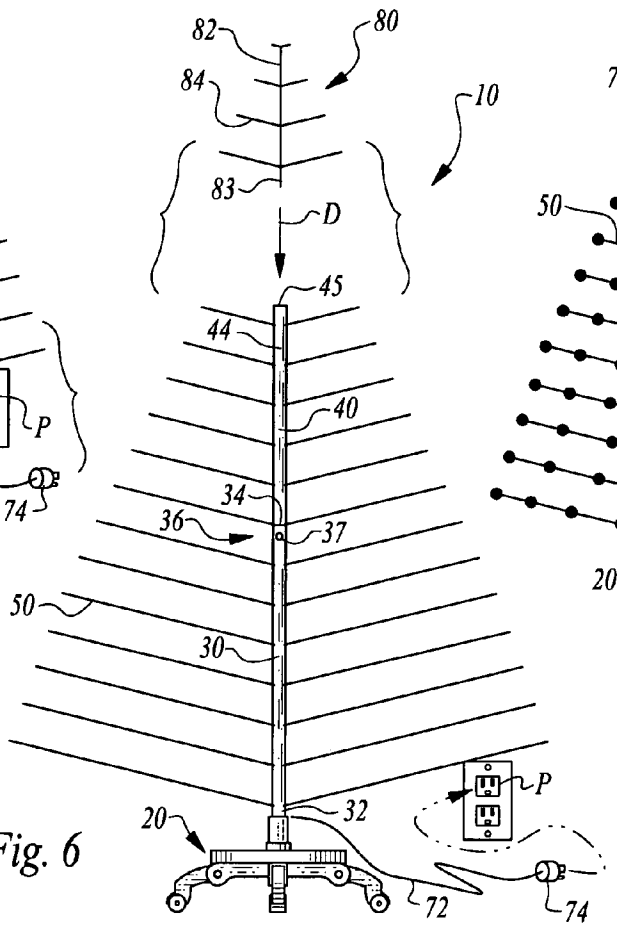

With particular reference to FIGS. 3, 6 and 7, details of the cap 80 are described, according to this preferred embodiment. Most preferably, to minimize an overall length of the rotating trunk 40 and height of the invertible Christmas tree 10 when in a stored configuration, an uppermost portion of the invertible Christmas tree 10 is configured as a separate cap 80. This separate cap 80 preferably includes a top trunk 82 which fits into the port 45 in the second end 44 of the rotating trunk 40. The cap 80 can thus be attached with the top trunk 82 colinear with the rotating trunk 40. To simplify attachment, it can occur when the rotating trunk 40 has been rotated halfway, or just a little more (see FIG. 9).

Top limbs 84 radiate from the top trunk 82 with a configuration similar to the limbs 50. A bottom end 83 of the cap 80 is sized to fit inside the port 45 for secure but removable attachment of the cap 80 to the rotating trunk 40. Lowermost portions of the cap 80 typically have a diameter similar to that of the invertible Christmas tree 10 when the limbs 50 are in their collapsed configuration (FIG. 3). Thus, the top limbs 84 of the cap 80 need not pivot relative to the top trunk 82. However, such pivoting could take place.

Also, most preferably a plug is provided and lights are provided on the cap 80 with the plug attachable to a plug in the second end 44 of the rotating trunk 40 so that the lights 70 on the cap 80 can be coupled to lights 70 on the rotating trunk 40 so that all of the lights 70 on the invertible Christmas tree 10 can be simultaneously powered from a single power receptacle P. Attachment of the cap 80 to the rotating trunk 40 is depicted along arrow D of FIG. 6.

Figure 22:
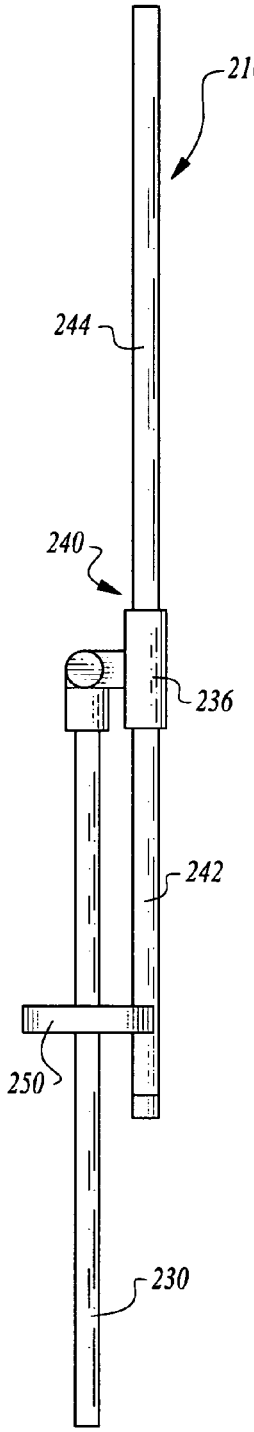
FIG. 22 is a side elevation view of an alternative Christmas tree similar to that which is shown in FIG. 11 showing the entire fixed trunk and rotating trunk according to a slightly different embodiment than that shown in FIGS. 1-11, and with limbs and branches not shown.
Figure 23:
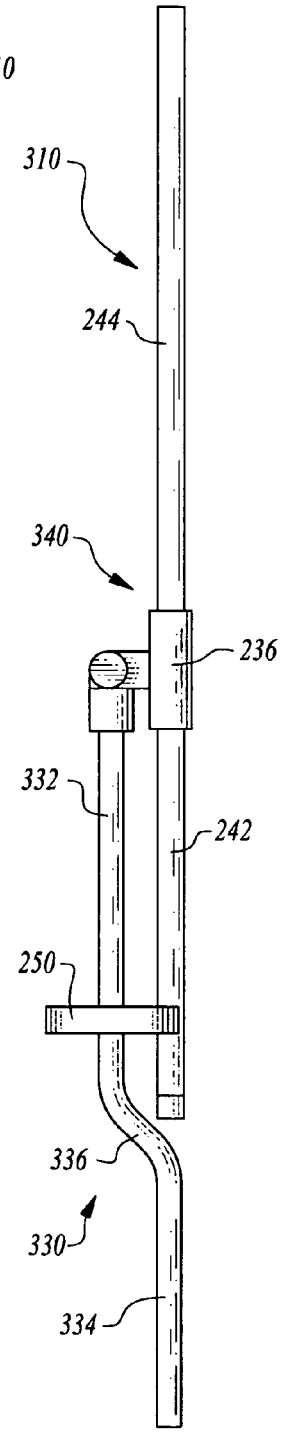
FIG. 23 is a side elevation view similar to that which is shown in FIG. 22 but for an alternative trunk configuration.
Figure 24:
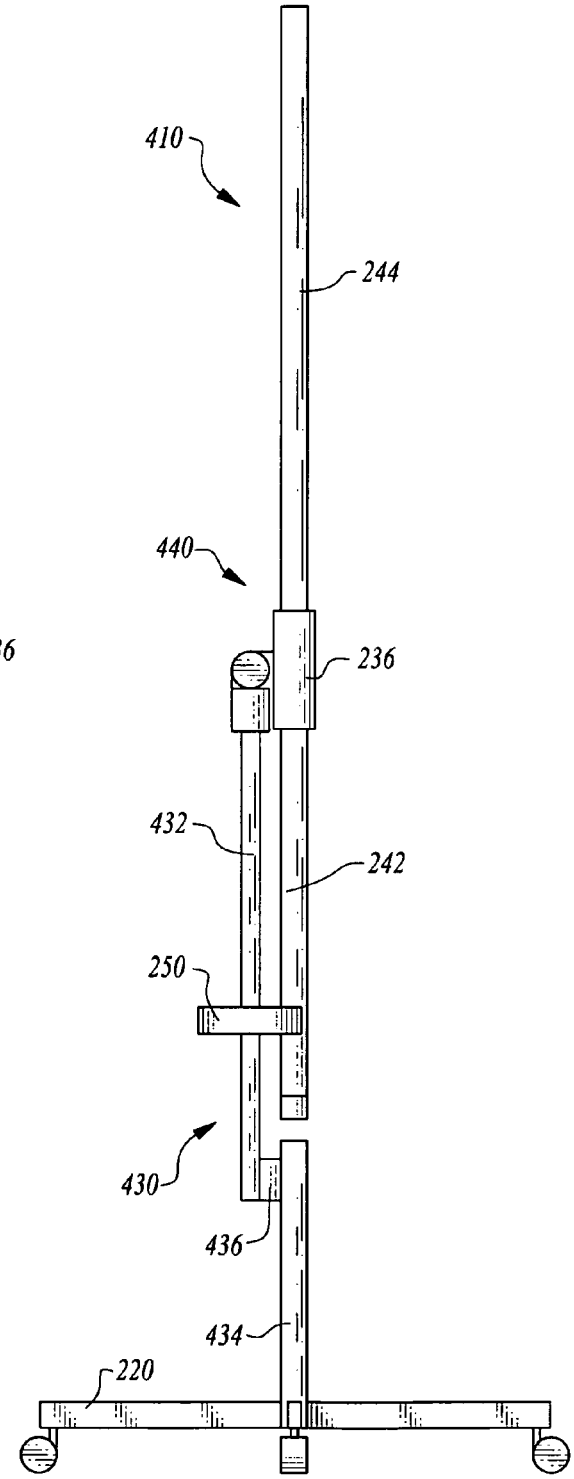
FIG. 24 is a side elevation view similar to that which is shown in FIG. 22 but for a still further alternative trunk configuration, and additionally showing the base thereon.

With particular reference to FIGS. 22-24, further details of the trunk of this invention are described and according to slightly different alternative embodiments for the trunk, including alternatives to the fixed trunk 30 and rotating trunk 40 (FIGS. 1-11). In FIG. 22 an alternative Christmas tree 210 is shown including a fixed trunk 230 and a rotating trunk 240. A joint such as the alternative joint 136 is provided and marked as alternative joint 236 joining the rotating trunk 240 to the fixed trunk 230.

Also, a releasable fastener 250 is shown for securing the rotating trunk 240 to the fixed trunk 230 both when in the deployed orientation and in the stored orientation. This releasable fastener 250 would typically have two sides which are similarly configured to grip either the upper portion 244 of the rotating trunk 240 or the lower portion 242 of the rotating trunk 240. The fastener 250 could, in one embodiment, be a pair of similar "C-shaped" clamps formed of a resilient material to releasably hold the rotating trunk 40 in one of the two pairs of clamps.

In this alternative Christmas tree 210, the rotating trunk 240 is shown with an asymmetrical configuration with the upper portion 244 longer than the lower portion 242. In such a configuration the joint 236 can be spaced away from a center of mass of the rotating trunk 240, or the positioning of limbs of different lengths and weights on the two portions 242, 244 can be provided so that the rotating trunk 240 is still balanced about the joint 236.

With the alternative Christmas tree 210, the rotating trunk 240 is shown displaced laterally relative to the fixed trunk 230 slightly when the rotating trunk 240 has been rotated to the deployed configuration. Similarly, when the rotating trunk 240 is rotated to the stored position, the rotating trunk 240 is also slightly displaced laterally from the fixed trunk 230, but on an opposite side of the fixed trunk 230. With this alternative embodiment Christmas tree 210, such an offsetting of the rotating trunk 240 from the fixed trunk 230 is merely accepted as part of the design of the alternative Christmas tree 210 and the base 220 (FIG. 24) is configured to accommodate any potential offsetting of the center of gravity of the overall alternative Christmas tree 210 to maintain stability.

Alternatively, limbs and branches can be configured with a slightly greater length on one side than on the other side to balance the alternative Christmas tree 210 laterally even though the rotating trunk 240 is offset laterally relative to the fixed trunk 230 somewhat. As another alternative, the fixed trunk 230 could be attached to the base 220 (FIG. 24) at a location slightly spaced from a center of the base 220, or the base 220 can be configured to be asymmetrical to balance the alternative Christmas tree 210 to prevent any tipping propensity.

A further alternative Christmas tree 310 is depicted in FIG. 23. This alternative Christmas tree 310 includes a fixed trunk 330 pivotably attached to the rotating trunk 340 through a joint 236. The rotating trunk 340 is similar to the rotating trunk 240, such that it includes an upper portion 244 and lower portion 242 which in this embodiment are shown having slightly different lengths.

Uniquely with the further alternative embodiment Christmas tree 310, the fixed trunk 330 is configured to include three separate parts: an upper part 332, a lower part 334 and a bend 336 between the upper part 332 and the lower part 334. This bend 336 includes upper and lower curves so that the upper part 332 and lower part 334 remain parallel to each other but are offset laterally relative to each other an amount similar to the lateral offset provided by the joint 236. In this way, the rotating trunk 340 is aligned with the lower part 334 of the fixed trunk 330 when the rotating trunk 340 is in the deployed configuration. The releasable fastener 250 is coupled to the upper part 332 and is similar to the releasable fastener 250 provided with the Christmas tree 210 (FIG. 22). The further alternative Christmas tree 310 is configured so that the trunk is balanced and symmetrical when in the deployed configuration, aligned with both the lower part 334 of the fixed trunk 330 and the base 220 (FIG. 24) to which the lower part 334 of the fixed base 330 is attached.

When the rotating trunk 340 is rotated to the stored position, in this embodiment a somewhat less balanced configuration would result, or the base 20 could be appropriately modified to provide stability both when the further alternative Christmas tree 310 is in the deployed configuration or in the stored configuration. Other techniques for balancing the further alternative Christmas tree 310 when in the stored configuration could also be resorted to, including adding masses to portions of the tree 310 when in the stored configuration to achieve balance, or limiting rotation of some of the limbs coupled to the tree 310 so that balance is maintained when the limbs pivot because some of the limbs pivot more than other limbs. Also, it is conceivable that the cover 2 (FIGS. 1 and 2) could be weighted and provided with a specified orientation so that the cover 2 would provide necessary balancing of a tree 310 when in the stored configuration.

With particular reference to FIG. 24 an additional further alternative embodiment of the Christmas tree 410 is disclosed. With the tree 410, an offset similar to that provided with the alternative Christmas tree 310 (FIG. 23) is provided. However, rather than utilizing the bend 336 (FIG. 23) a coupling 436 is provided to join the upper part 432 of the fixed trunk 430 to a lower part 434 of the fixed trunk 430. In this embodiment, the upper part 432 and lower part 434 can each be entirely linear, but the offset is still provided similar to that provided with the tree 310 (FIG. 23). Other details of the tree 410 are similar to that disclosed in the tree 310 of FIG. 23.

The tree 410 is also shown coupled to the base 220 which would typically be similar for each of the embodiments of FIGS. 22-24. This base 220 is similar to the base 20 (FIGS. 1-11) except that it is shown in a simplified form without collapsibility and clearly depicting the wheels as caster wheels which can rotate about a vertical axis to swivel and allow the tree 410 to be rolled on a flat surface easily in a variety of different directions.

The alternative trees 210, 310, 410 shown in FIGS. 22-24 can have details thereof selectively combined with details of the joints shown in FIGS. 18-21 and also selectively combined with details of the tree 10 of FIGS. 1-11. Also, various different limbs and branches and lights can be coupled to trees such as the alternative trees 210, 310, 410 to configure a tree according to this invention to meet the desires of a particular consumer.

Figures 25, 26, 27, 28:
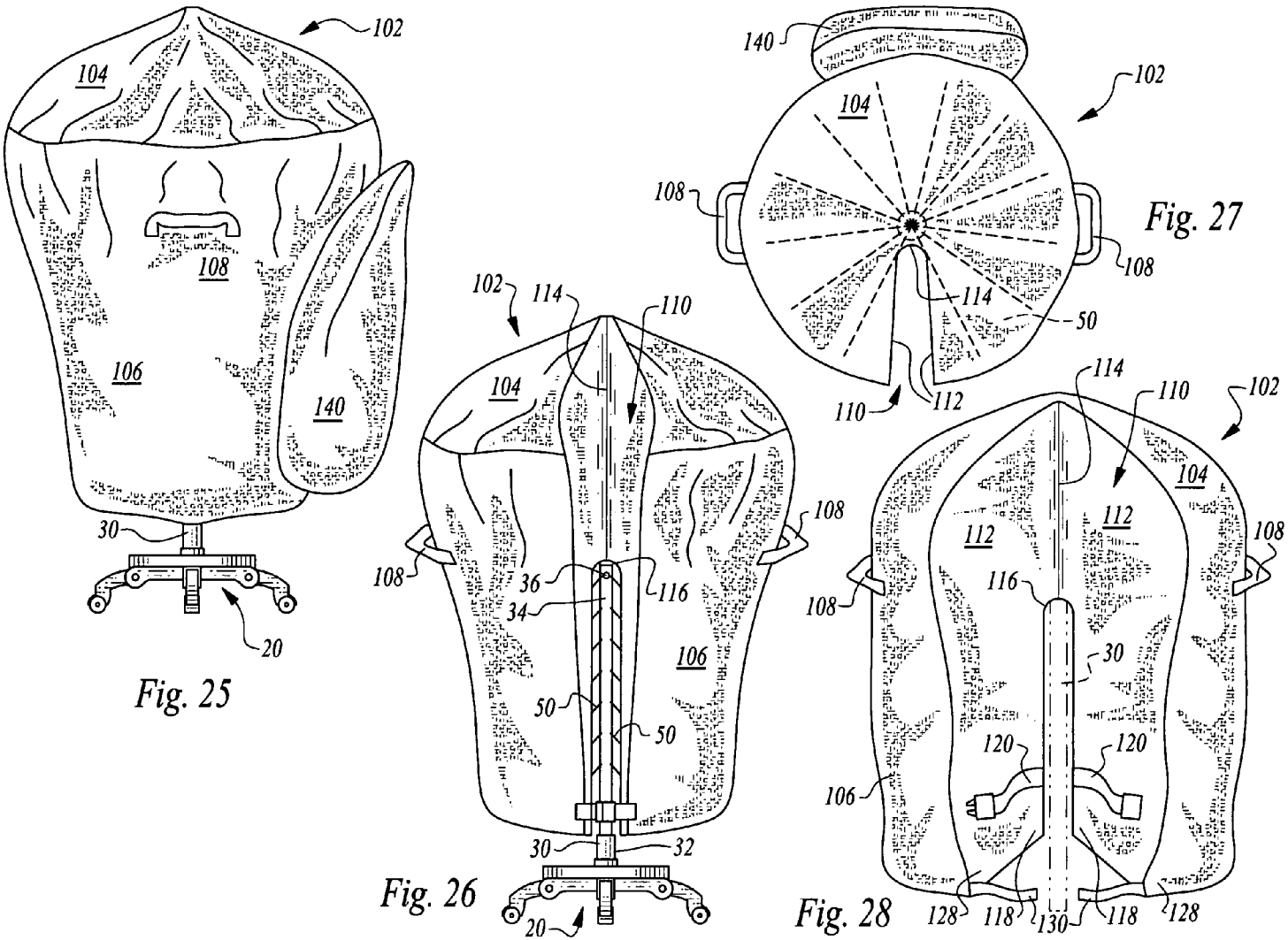
FIG. 25 is a front elevation view of the Christmas tree of this invention contained within an alternative cover for the Christmas tree, which cover is inverted with the tree during deployment.
FIG. 26 is a side elevation view of that which is shown in FIG. 25.
FIG. 27 is a top plan view of that which is shown in FIG. 25 with limbs of the Christmas tree shown in broken lines as they are positioned contained within the cover.
FIG. 28 is a side elevation view of that which is shown in FIG. 25 with a gap formed in the cover spread open more than would typically be the case to most clearly show details of portions of the cover within the gap and with portions of the trunk fixed portion of the Christmas tree shown in broken lines.
Figures 29, 30, 31:
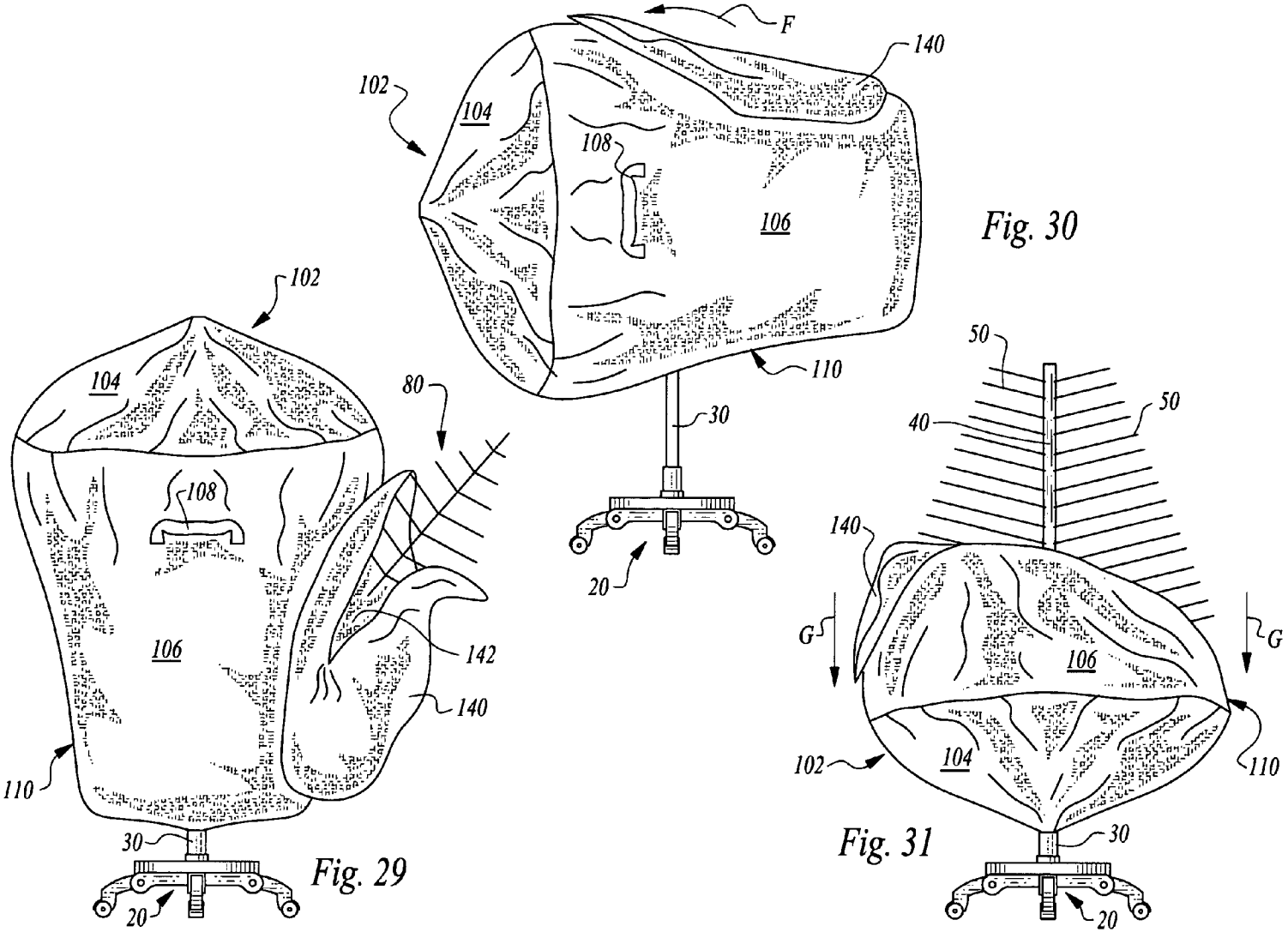
FIG. 29 is a side elevation view of that which is shown in FIG. 25 with a side pouch thereof opened and with a cap portion of the Christmas tree in the process of being removed from the side pouch.
FIG. 30 is a front elevation view similar to that which is shown in FIG. 25, but after rotation of the Christmas tree halfway from a stored position to a final deployed position, and illustrating how the alternative cover can rotate with the Christmas tree, rather than requiring removal of the cover before rotation.
FIG. 31 is a front elevation view similar to that which is shown in FIG. 25, but after complete rotation of the Christmas tree with the cover in place, and showing the cover in the process of being removed by pulling downward on the cover.

With particular reference to FIGS. 25-31 details of an alternative cover 102 for the Christmas tree 10 are described. This alternative cover 102 generally is wider than the cover 2 of the previously described embodiment, such as to accommodate Christmas trees 10 which have limbs 50 which rotate less than those depicted in the previous embodiment discussed above. The cover 102 generally includes a top panel 104 and a side panel 106. The top panel 104 is generally circular but can be configured to be semi-spherical or semi-conical in form so that it can take on a somewhat domed configuration. This top panel 104 preferably is substantially complete in form except where a gap 110 forms a break in the top panel 104 (FIG. 27).

The side panel 106 is generally cylindrical in form, except that the side panel 106 preferably has a slightly lesser diameter at a lower end than at an upper end adjacent the top panel 104. The side panel 106 is preferably open at a lower end and otherwise substantially continuous except where the gap 110 causes a break in the side panel 106 (FIGS. 26 and 28). Handles 108 are preferably attached to the side panel 106 on a front and rear side of the cover 102. These handles 108 assist in moving the tree under the cover 102 and rotating the cover 102 and included Christmas tree upon the wheeled base 20.

The gap 110 is somewhat in the form of a pie shaped cutout extending from upper to lower ends of the cover 102. This gap 110 is primarily defined by two substantially planar side walls 112 which almost face each other but preferably are angled slightly (perhaps 5° to 15°) away from each other. These side walls 112 are joined together at an inner joint 114 close to a central vertical axis of the cover 102. The gap 110 is configured so that it can fit between two adjacent limbs 50 (FIG. 27) and to allow the cover 102 to remain on the tree 10 as the tree 10 is rotated (FIG. 30) between a stored orientation and a deployed orientation. After transitioning to the deployed orientation (FIG. 31), the cover 102 is then removed.

The gap 110 provides clearance to allow the fixed trunk 30 of the Christmas tree 10 (FIGS. 1-24) to transition from one orientation relative to a remainder of the Christmas tree to another orientation relative to the entire Christmas tree, associated with rotation of portions of the Christmas tree relative to the fixed trunk 30. Such rotational clearance can perhaps best be seen with reference to FIG. 26 or 28 where an upper portion of the cover 102 and contained Christmas tree rotate toward the viewer out of the page with lower portions of the cover 102 and associated Christmas tree rotating away from the viewer and into the page. This rotation can also be seen in FIG. 30 where the gap 110 is illustrated by an arrow to indicate where it is actually located (also in FIG. 29).

The inner joint 114 of the gap 110 includes an arch 116 which defines a break in the inner joint 114 so that the inner joint 114 only joins the side panels 112 on an upper half of the gap 110. A lower half of the inner joint 114 below the arch 116 is open between two inside edges of the side walls 112. This open portion of the inner joint 114 below the arch 116 is beneficial in facilitating removal of the cover 102 after completion of the rotation process (along arrow G of FIG. 31).

To keep portions of the cover 102 within the gap 110 properly positioned in spite of this open portion of the inner joint 114 below the arch 116, inner corners 118 of the side walls 112 preferably include an inner fastener 120. This inner fastener 120 is initially wrapped around the fixed trunk 30 and coupled together to keep the inner corners 118 of the side walls 112 of the gap 10 positioned where desired and to resist any tendency of the cover 102 to rotate prematurely. When the cover 102 and included tree are to be rotated, this inner fastener 120 would typically be manipulated into a detached configuration to then allow free rotation of the cover 102 and included Christmas tree (along arrow F of FIG. 30). If desired, an outer fastener 130 can be provided at outer corners 128 of the gap 110 to help keep the gap 110 substantially closed. A similar outer fastener 130 could optionally be provided at corners of the side walls 112 adjacent the top panel 104. These outer fasteners 130 would also be attached when the cover 102 is in a stored configuration and then detached before rotation but before removal of the cover 102.

The alternative cover 102 is beneficial for larger trees, where a shorter user might have difficulty in lifting the cover 2 of the previous embodiment up off of the tree after rotation. With this alternative cover 102, the cover 102 is pulled down (along arrow G of FIG. 31) after rotation of the cover 102 and included Christmas tree, so that the user need not be required to lift the cover 102 up off of the Christmas tree. The cover 102 can later be repositioned on the Christmas tree, either by reversing the cover 102 removal steps or by first inverting the tree to the stored position and then pulling the cover 102 down over the top of the inverted Christmas tree.

The alternative cover 102 includes a side pouch 140 sized to receive the cap 80 of the Christmas tree therein. An access opening 142 is provided, typically with a zipper thereon or other closure. The inside pouch 140 is sized sufficiently large to allow the cap portion of the Christmas tree to be replaceably positioned within the side pouch 140.

With particular reference to FIGS. 32-36, details of a two pivot Christmas tree 510 defining an alternative embodiment of the Christmas tree 10 described above are described. This two pivot Christmas tree 510 utilizes the same basic principle of one fixed trunk and at least one rotating trunk, but adds to the principle by providing multiple separate rotating trunk portions. With such a configuration, trees of increased height can be readily managed by a single user without requiring a step ladder or excessive strength. Also, a size of the collapsed tree can be minimized, such as to accommodate transport through standard doorways and other standard building area dimensions.

Figure 36:
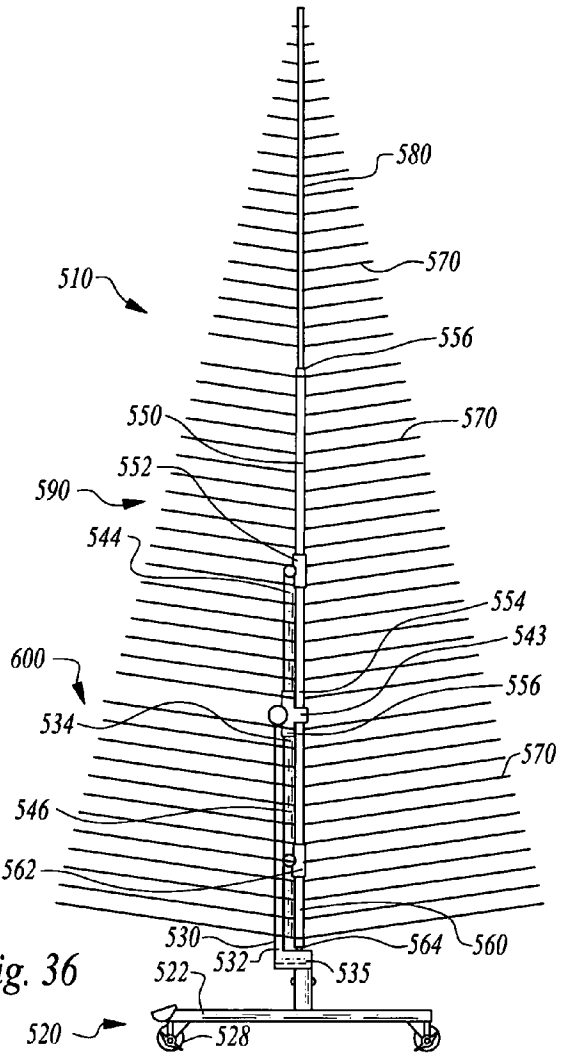
FIG. 36 is a front elevation view of the two pivot Christmas tree after completion of all rotations and completion of transitions from the stored position to the deployed position.

The entire two pivot Christmas tree 510 rests upon a base 520 which consists essentially of a rigid frame 522 having various different elements to provide rigidity to the base 520. Wheels 528 support the base 520 above ground and allow for simple and easy rolling movement of the two pivot Christmas tree 510 to a desired position before transitioning of the Christmas tree 510 from its stored configuration (FIGS. 32 and 33) to its final deployed configuration (FIG. 36).

The two pivot Christmas tree 510 includes four basic trunk portions including a fixed trunk 530, an intermediate rotating trunk 540, an upper rotating trunk 550 and a lower rotating trunk 560. The fixed trunk 530 is generally similar to the fixed trunk 30 of the Christmas tree 10 described in detail above. Specifically, in this embodiment the fixed trunk 530 includes a lower end 532 opposite an upper end 534 and is rigid and elongate in form extending vertically up from the base 520. Preferably, an offset 535 is formed in the fixed trunk 530 near the lower end 532 to assist in balancing the different portions of the two pivot Christmas tree 510 over a center point of the base 520.

The intermediate rotating trunk 540 is pivotably attached through a middle pivot 542 to the upper end 534 of the fixed trunk 530. This intermediate rotating trunk 540 is similar to the fixed trunk 530 in that it does not have limbs extending directly therefrom. The intermediate rotating trunk 540 is distinct from the fixed trunk 530 in that it is capable of rotating relative to the fixed trunk 530 at least 90° about the middle pivot 542.

The middle pivot 542 is preferably at a center of the intermediate rotating trunk 540 to maintain balance and thus simplicity of rotation of the intermediate rotating trunk 540. As an alternative, the middle pivot 542 could be placed at different locations along the intermediate rotating trunk 540. A clasp 543 is preferably provided as part of the middle pivot 542 which can secure the upper rotating trunk 550 and lower rotating trunk 560 in deployed configuration relative to the intermediate rotating trunk 540 after rotation thereof (along arrows H and I of FIG. 32). In one form of the invention, the clasp 543 can be in the form of an open "C" clamp with the upper and lower rotating trunks 550, 560 having a circular cross-section which can snap into the C-clamp configured clasp 543.

Figure 32:
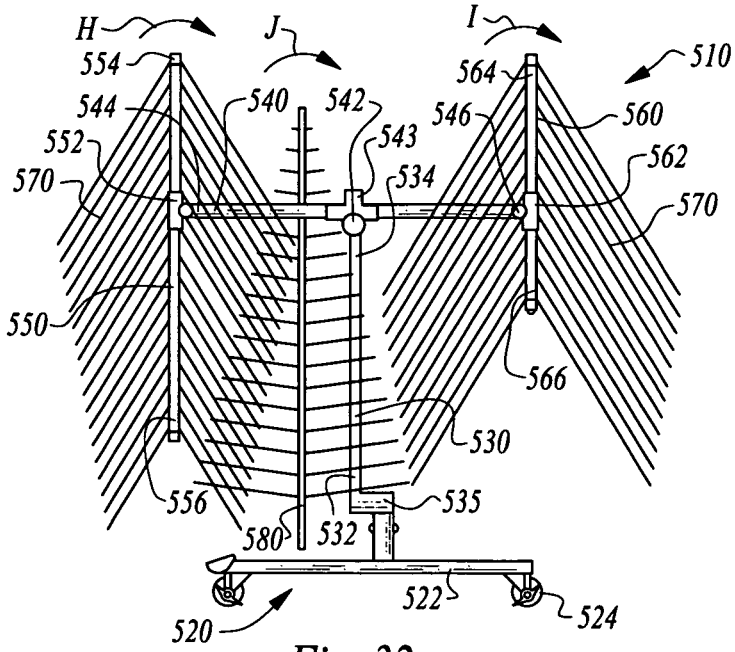
FIG. 32 is a front elevation view of a multiple pivot Christmas tree alternative embodiment of this invention.
Figure 35:
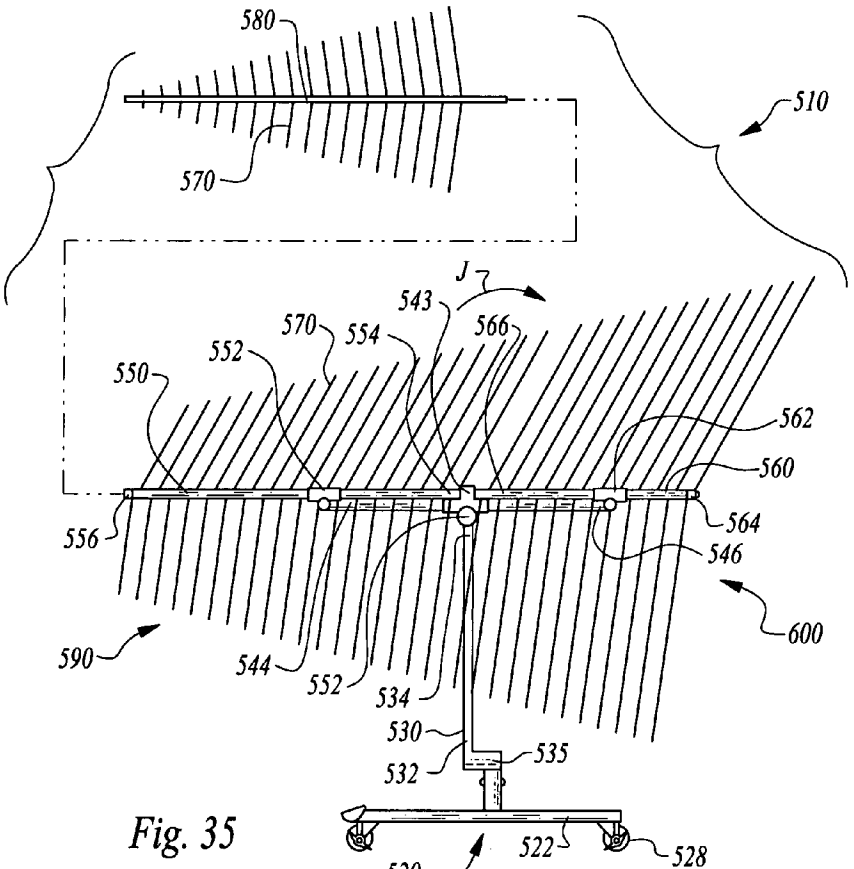
FIG. 35 is a front elevation view of that which is shown in FIG. 32 after the upper rotating trunk and a lower rotating trunk have each been rotated 90° and before final rotation of an intermediate rotating trunk to complete the transition of the multiple pivot Christmas tree from its stored configuration to its deployed configuration, and also illustrating how a cap portion of the Christmas tree is attached to an upper rotating trunk of the Christmas tree before final rotation of the intermediate rotating trunk.

The intermediate rotating trunk 540 includes a high end 544 opposite a low end 546. In the stored position, each of these ends 544, 546 are at a common height as the intermediate rotating trunk 540 is configured to extend horizontally (FIGS. 32 and 35). In a final rotating step (about arrow J of FIGS. 32 and 35) the intermediate rotating trunk 540 is rotated relative to the fixed trunk 530, and about the middle pivot 142 ninety degrees until the high end 544 is directly above the low end 546.

The upper rotating trunk 552 is pivotably coupled to the high end 544 of the intermediate rotating trunk 540. In particular, a middle pivot 552 is interposed between the high end 544 of the intermediate rotating trunk 540 and the upper rotating trunk 550 at a point between a first end 554 and a second end 556 of the upper rotating trunk 550. The first end 554 of the upper rotating trunk 550 is that portion of the upper rotating trunk 550 which is configured to have longer limbs than limbs extending from the second end 556. When completely deployed, the upper rotating trunk 550 defines a middle portion of the two pivot Christmas tree 510. The middle pivot 552 facilitates ninety degrees of rotation between the upper rotating trunk 550 and the intermediate rotating trunk 540.

The lower rotating trunk 560 is pivotably attached to the low end 546 of the intermediate rotating trunk 540. In particular, a middle pivot 562 is interposed between the low end 546 of the intermediate rotating trunk 540 and a portion of the lower rotating trunk 560 between a first end 564 and a second end 566 of the lower rotating trunk 560. The first end 564 of the lower rotating trunk 560 is configured to have limbs 570 which are longer than limbs 570 extending from the second end 566 of the lower rotating trunk 560. The middle pivot 562 facilitates ninety degrees of rotation between the lower rotating trunk 560 and the intermediate rotating trunk 540. After transition to the deployed configuration, the lower rotating trunk 560 defines a lowermost portion of the two pivot Christmas tree 510.

The limbs 570 are generally similar to those described above for various different alternative embodiments of the Christmas tree 10 (FIGS. 1-24). Branches would also typically extend from the limbs 570 and lights can optionally be provided on the limbs 570 and/or branches. Electric wiring for such lights is preferably routed up the fixed trunk 530 to the intermediate trunk 540 at the middle pivot 512. The wiring can then split into two paths, one extending to the high end 544 and one extending to the low end 546. At these joints, the wiring again splits to extend on to first ends 554, 564 and second ends 556, 566 of the upper rotating trunk 550 and lower rotating trunk 560. Lights are then coupled to the wiring lanes adjacent where the limbs 570 couple to the trunks 550, 560.

A cap 580 is preferably provided which is attachable to the second end 556 of the upper rotating trunk 550 to define an uppermost portion of the two pivot Christmas tree 510. This cap 580 would typically be attached to the upper rotating trunk 150 after rotation of the upper rotating trunk 550 and lower rotating trunk 560 relative to the intermediate rotating trunk 540 (along arrows H and I of FIG. 32) but before final rotation of the intermediate rotating trunk 540 (along arrow J of FIGS. 32 and 35). Typically the cap 580 merely includes a lower tip which can be telescopically received into a hollow bore formed coaxially within the second end 556 of the upper rotating trunk 550. If required, electrical connections can also be made adjacent this interface so that lights on limbs 570 of the cap 580 can receive power.

Figure 33:
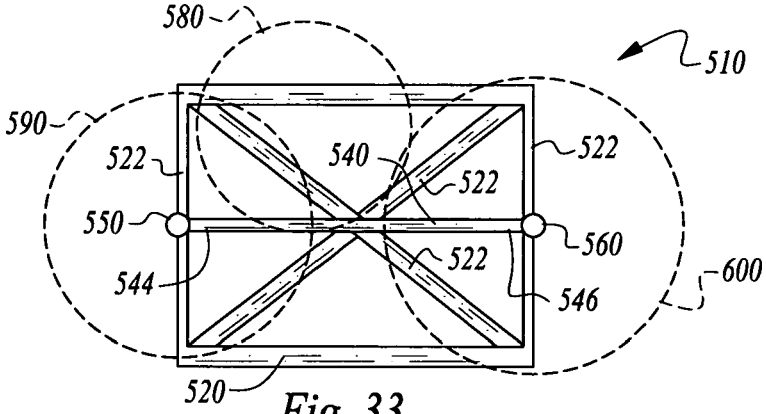
FIG. 33 is a top plan view of that which is shown in FIG. 22 with a contour of separate sections of the tree generally indicated by circles shown in broken lines.
Figure 34:
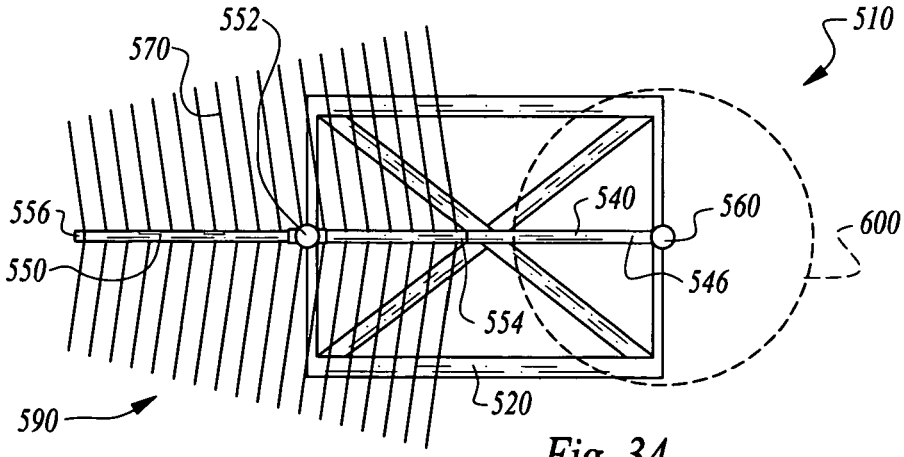
FIG. 34 is a top plan view similar to that which is shown in FIG. 33, but with an upper rotating trunk having been rotated 90° according to a first step in transiting the two pivot Christmas tree from its stored position shown in FIG. 32 and a final deployed position shown in FIG. 36.

As best seen in FIGS. 32-34, the two pivot Christmas tree 510 has a relatively short and compact form when in the stored position. A general outline of tips of the limbs 570 are depicted in top plan views (FIGS. 33 and 34) by circular broken lines generally defining an upper tree portion 590 supported upon the upper rotating trunk 550 and a lower tree portion 600 defined by the limbs extending from the lower rotating trunk 560.

In one embodiment, a final deployed Christmas tree (FIG. 36) of approximately sixteen feet tall can be collapsed into an approximately six foot tall compact package which can be readily handled and transported by a single user. Not only does this two pivot Christmas tree 510 facilitate the simple deployment of an exceptionally large Christmas tree in a simple and fast manner, but also decorations can conceivably be at least partially attached to the two pivot Christmas tree 510 before final rotation of the intermediate rotating trunk 540 (along arrow J of FIG. 35) so that a user can more easily place ornaments on the Christmas tree before final rotation when at least upper portions of the two pivot Christmas tree 510 on the cap 580 and upper tree portion 590 are not as readily accessed. At a minimum, the cap 580 can be entirely decorated before attachment to the upper rotating trunk 550 and then a single short ladder can be utilized for decoration of the upper tree portion 590 and lower tree portion 200.

When restorage of the two pivot Christmas tree 510 is desired, the steps in deployment are reversed until the two pivot Christmas tree 510 has been transitioned again to its stored configuration (FIG. 32). Typically, a cover is provided to protect the tree 510 in this collapsed orientation. Handles can also extend up from the base 520 to a convenient height so that a user can maneuver the tree 510 on the wheeled base 520 without pushing directly on the limbs 570 of the tree 510. Such handles are preferably either removable or collapse down to the base 520 when not in use after the tree 510 is deployed at a particular location.

Figure 37:
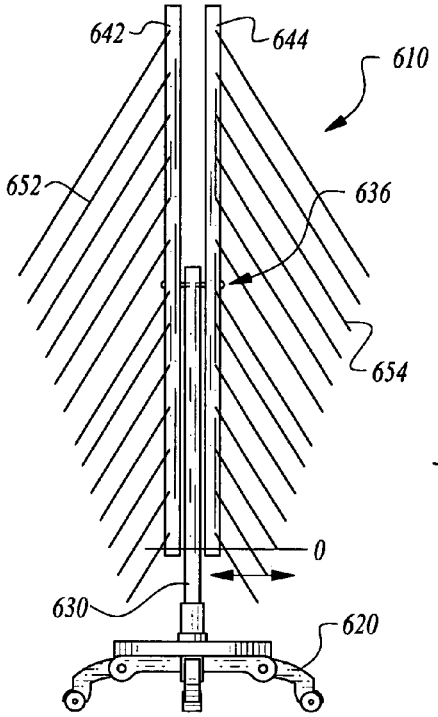
FIG. 37 is a side elevation view of a further alternative embodiment artificial tree according to this invention, featuring two pivoting upper trunk portions.

FIG. 37 is a side elevation view of a further alternative embodiment of the artificial tree of this invention. In this alternative embodiment, an artificial tree 610 is shown. The tree 610 includes a base 620 with a fixed trunk 630 extending vertically up from the base 620. At an upper end of the fixed trunk 630 a pivot 636 is provided. Uniquely, with this tree 610, two upper trunks 642, 644 are provided. Each of the two upper trunks 642, 644 each rotate about the common pivot joint 636 to attach the upper trunk 642, 644 to the lower trunk 630. The first upper trunk 642 includes limbs 652 extending therefrom similar to limbs of previous embodiments. The second upper trunk 644 includes limbs 654 pivotably attached thereto in a manner similar to limbs in embodiments discussed above. Each of the upper trunks 642, 644 are configured to rotate 180° about the pivot 636. When in the stored orientation, as shown in FIG. 37, the upper trunks 642, 644 are inverted and in an upside down vertically extending orientation.

The first upper trunk 642 includes a lower end 643 which is elevated in this orientation and an upper end 641 that is lowered in this orientation (FIG. 37). The second upper trunk 644 includes a lower end 647 which is elevated in this orientation and an upper end 645 that is lowered in this orientation (FIG. 37).

Figure 38:
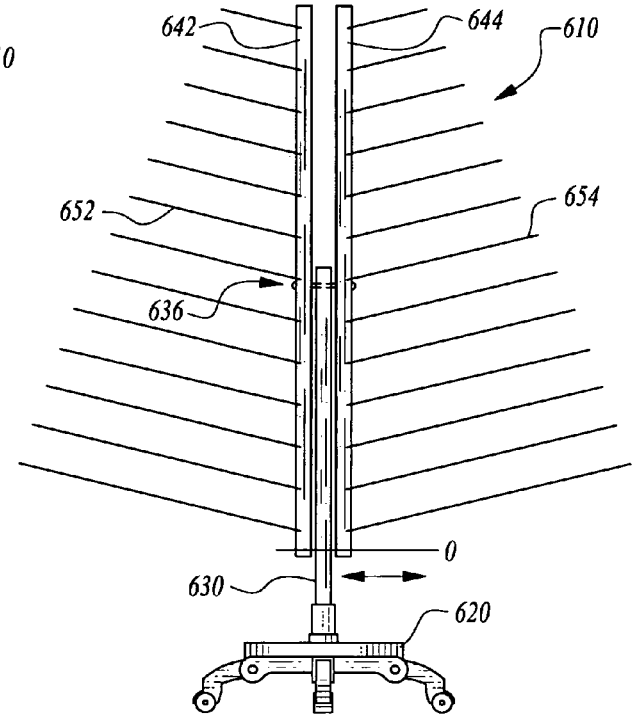
FIG. 38 is a side elevation view of the alternative trunk of FIG. 37 with the upper trunk portions having been rotated to transition the tree of this embodiment from the stored configuration to the deployed configuration.
Figure 39:
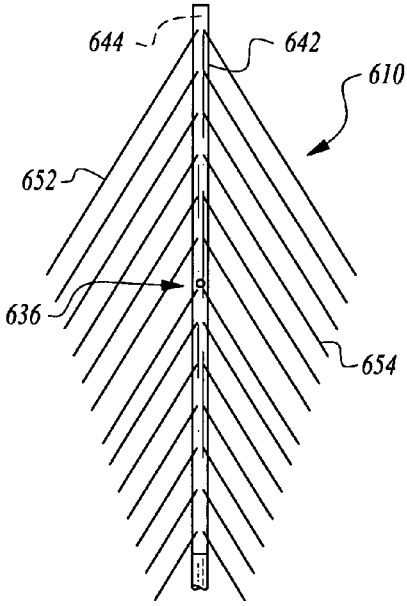
FIG. 39 is a front elevation view of that which is shown in FIG. 37.

As depicted in FIG. 38, after rotation of each of the upper trunks 642, 644 by a full 180°, the limbs 652, 654 extend outwardly somewhat and the upper ends 641, 645 of the upper trunks 642, 644 are at the uppermost position on the tree. FIG. 39 depicts the same tree 610 but from a front view. The two upper trunks 642, 644 are lined up with the trunk 642 in front of the trunk 644 so that only the trunk 642 can be seen.

Note that the limbs 652, 654 are configured with branches extending therefrom. As with previous embodiments described above. With the limbs 652, 654 and branches in place the upper trunks 642-644 are obscured so that the tree does not appear to have a dual trunk character. Also, a cap would typically be provided with a single central trunk portion. This cap would attach to one of the upper ends 641, 645 of the upper trunks 642, 644 or both.

Figure 40:
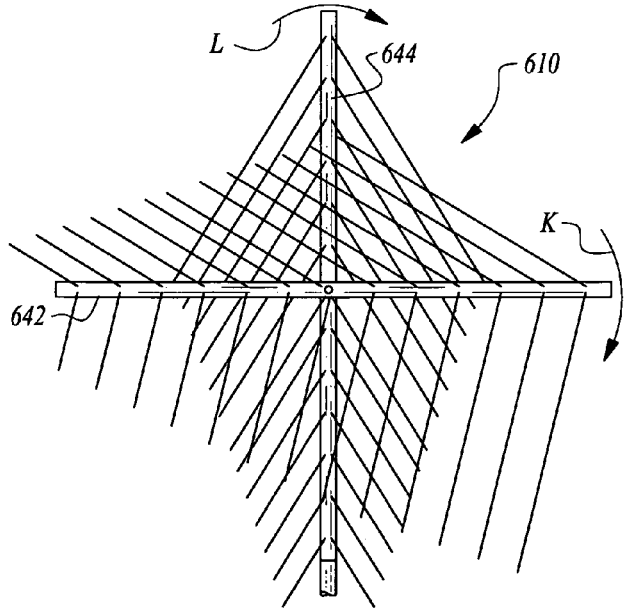
FIG. 40 is a front elevation view similar to that which is shown in FIG. 37, but after the beginning of the rotation process for one of the two portions of the upper trunk portion of the tree of this embodiment.

In FIG. 40 the beginning of the rotation process has begun, with the upper trunk 642 rotated 90° (about arrow K) and halfway from its stored position to its deployed position. The upper trunk 644 has not yet been rotated. After the upper trunk 642 has been rotated 180° (along arrow K of FIG. 40) it will be in its deployed configuration, such as that shown in FIG. 38. The upper trunk 644 is rotated about arrow L by a full 180° to transition from its stored position to its deployed position, as depicted in FIG. 38. Typically some form of latch (e.g. C-clamps, straps, cotter pins, etc.) would be provided along the lower trunk 630 to secure the upper trunks 642, 644 in both the stored and deployed configurations. Other details of this tree 610 can be similar to those described above with previous embodiments.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A collapsible Christmas tree, comprising in combination:

a first trunk portion;

said first trunk portion having an elongate form extending between an upper end and a lower end, said upper end above said lower end when said first trunk portion is supported upon a floor;

a second trunk portion having an elongate form between a first end and a second end;

said second trunk portion including a plurality of limbs extending laterally therefrom;

a pivot joint coupling said first trunk portion to said second trunk portion in a manner allowing pivoting of said second trunk portion relative to said first trunk portion;

said pivot joint interfacing with said first trunk portion at a location closer to said upper end than to said lower end; and said pivot joint interfacing with said second trunk portion at a location spaced from both said first end and said second end of said second trunk portion.

2. The collapsible Christmas tree of claim 1 wherein said plurality of limbs are attached to said second trunk portion in a manner which allows pivoting of said limbs relative to said second trunk portion.

3. The collapsible Christmas tree of claim 2 wherein said limbs are restricted to movement between substantially perpendicular to a longitudinal axis of said second trunk and a collapsed form with a tip of each limb closer to the second trunk portion than a deployed position extending substantially perpendicularly from said second trunk portion.

4. The collapsible Christmas tree of claim 1 wherein said pivot joint allows for at least about 180° of rotation of said second trunk portion relative to said first trunk portion.

5. The collapsible Christmas tree of claim 4 wherein said pivot joint includes an axle aligned with a rotational axis with said axle coupled directly to both said first trunk portion and said second trunk portion with said second trunk portion pivoting about said axle relative to said first trunk portion.

6. The collapsible Christmas tree of claim 5 wherein said pivot joint is located at substantially a midpoint of said second trunk portion.

7. The collapsible Christmas tree of claim 5 wherein said pivot joint is positioned at substantially a balance point of said second trunk portion aligned with a center of mass of said second trunk portion.

8. The collapsible Christmas tree of claim 4 wherein said pivot joint is located adjacent said upper end of said first trunk portion.

9. The collapsible Christmas tree of claim 1 wherein a plurality of lights are provided along at least one cord, said cord routed up said first trunk portion and transitioning from said first trunk portion to said second trunk portion adjacent said pivot joint with said cord feeding electric power to a plurality of lights deployed on at least one limb coupled to said second trunk portion.

10. The collapsible Christmas tree of claim 1 wherein said second end of said second trunk portion is attachable to a bottom end of a cap portion of the collapsible Christmas tree, said cap portion including a top trunk and top limbs extending laterally from said top trunk with said top trunk substantially aligned with said second trunk portion when said bottom end of said cap is coupled to said second end of said second trunk portion.

11. A method for erecting a collapsible Christmas tree, the steps including:

providing a Christmas tree having a first trunk portion, the first trunk portion having an elongate form extending between an upper end and a lower end, the upper end above the lower end when the first trunk portion is supported upon a floor, a second trunk portion having an elongate form between a first end and a second end, the second trunk portion including a plurality of limbs extending laterally therefrom, a pivot joint coupling the first trunk portion to the second trunk portion in a manner allowing pivoting of the second trunk portion relative to the first trunk portion, the pivot joint associated with the first trunk portion at a location closer to the upper end than to the lower end, and the pivot joint associated with the second portion at a location spaced from both the first end and the second end of the second trunk portion;

initially positioning the collapsible Christmas tree with the first trunk portion extending substantially vertically with the first end of the second trunk portion above the second end of the second trunk portion and with the second trunk portion extending substantially vertically; and pivoting the second trunk portion about the pivot joint substantially 180° to be substantially vertical with the second end above the first end.

12. The method of claim 11 including the further step of allowing the limbs coupled to the second trunk portion to pivot relative to the second trunk portion between a substantially perpendicular orientation relative to the second trunk portion and a collapsed orientation pivoted closer to the second trunk portion with the limbs in the collapsed orientation when the first end of the second trunk portion is above the second end of the second trunk portion and with the limbs extending substantially horizontally when the second end of the second trunk portion is located above the first end of the second trunk portion.

13. The method of claim 11 including the further step of securing the first end of the second trunk portion to a portion of the first trunk portion in a temporary fashion to hold the second trunk portion in a deployed position with the second end of the second trunk portion above the first end of the second trunk portion.

14. The method of claim 11 including the further step of providing a cap having a top trunk with a plurality of top limbs extending laterally from the top trunk, the top trunk removably attachable to the second end of the second trunk portion with the top trunk extending substantially colinearly with said second trunk portion; and attaching the top trunk of the cap portion to the second end of the second trunk portion.

15. The method of claim 11 including the further steps of:

providing a cover with a height similar to a length of the first trunk portion plus about half of a length of the second trunk portion and with a width similar to a width of the Christmas tree when in a collapsed form with the first end of the second trunk portion above the second end of the second trunk portion, such widths defined by tips of limbs attached to the second trunk portion.

16. The method of claim 15 including the further step of removing the cover before said pivoting step.

17. The method of claim 15 including the further step of removing the cover after said pivoting step.

18. The method of claim 11 including the further steps of:

providing a wheeled base;

fixing the lower end of the fixed trunk to the wheeled base; and using the wheeled base to transport the Christmas tree from a storage location to a location where deployment of the tree is intended.

19. An invertible artificial tree, comprising:

a first trunk portion with an upper end above a lower end;

a second trunk portion with a first end opposite a second end;

a pivot joint on said second trunk portion;

said second trunk portion joined to said first trunk portion at said pivot joint between said first end and said second end; and a plurality of limbs extending laterally from said second trunk portion.

20. The artificial tree of claim 19 wherein said pivot joint allows rotation of said second trunk portion substantially 180° relative to said first trunk portion.

21. The artificial tree of claim 20 wherein said plurality of limbs are pivotably attached to said second trunk portion, such that said limbs can pivot by gravity from a collapsed position to a deployed position with tips of said limbs closer to said second trunk portion when said limbs are in said collapsed position than in said deployed position.

22. The artificial tree of claim 21 wherein lights are coupled to said limbs, said lights coupled to a light cord routed up said first trunk portion, then to said second trunk portion before being coupled to said lights to supply power to said lights.

23. The artificial tree of claim 19 wherein said second trunk portion is oriented substantially parallel with said first trunk portion both before and after rotation of said second trunk portion relative to said first trunk portion about said pivot joint.

24. The artificial tree of claim 19 wherein a clasp is removably attachable between said first trunk portion and a portion of said second trunk portion, between where said second trunk portion is coupled to said pivot joint and said first end of said second trunk portion, to keep said second trunk portion locked in a deployed position until said clasp is removed.

* * * * *

UNITED STATES PATENT AND TRADEMARK OFFICE

CERTIFICATE OF CORRECTION

PATENT NO. : 8,062,718 B2
APPLICATION NO. : 12/798496
DATED : November 22, 2011
INVENTOR(S) : Bruce A. Schooley It is certified that error appears in the above-identified patent and that said Letters Patent is hereby corrected as shown below:

On the title page:

Please add Item (63): --Related U.S. Application Data
Continuation-in-part of application No. PCT/US2008/001358, filed on Dec. 10, 2008.--

In the Specification:

Column 1, line 6: After the words "This application", please add --is a CONTINUATION-IN-PART of and--.

Signed and Sealed this
Seventeenth Day of May, 2016

Michelle K. Lee

Michelle K. Lee
*Director of the United States Patent and Trademark Office*